US010286279B2

(12) United States Patent
Wehrell

(10) Patent No.: US 10,286,279 B2
(45) Date of Patent: May 14, 2019

(54) LATERAL TRAINING SYSTEM AND METHOD

(75) Inventor: Michael A. Wehrell, Tampa, FL (US)

(73) Assignee: Vertimax, LLC, Tampa, FL (US)

( * ) Notice: Subject to any disclaimer, the term of this patent is extended or adjusted under 35 U.S.C. 154(b) by 684 days.

(21) Appl. No.: 12/155,747

(22) Filed: Jun. 9, 2008

(65) Prior Publication Data

US 2008/0300118 A1 Dec. 4, 2008

Related U.S. Application Data

(63) Continuation-in-part of application No. 10/892,568, filed on Jul. 16, 2004, now Pat. No. 7,494,453.
(Continued)

(51) Int. Cl.

| | |
|---|---|
| ***A63B 21/04*** | (2006.01) |
| ***A63B 21/05*** | (2006.01) |
| ***A63B 69/00*** | (2006.01) |
| ***A63B 21/00*** | (2006.01) |
| ***A63B 21/16*** | (2006.01) |

(Continued)

(52) U.S. Cl.
CPC ..... *A63B 69/0028* (2013.01); *A63B 21/04* (2013.01); *A63B 21/154* (2013.01); *A63B 21/16* (2013.01); *A63B 21/169* (2015.10); *A63B 21/4001* (2015.10); *A63B 21/4009* (2015.10); *A63B 21/4011* (2015.10); *A63B 23/035* (2013.01); *A63B 23/047* (2013.01);
(Continued)

(58) Field of Classification Search
CPC ..... A63B 21/02; A63B 21/04–21/0557; A63B 21/0442; A63B 21/4001; A63B 21/0421; A63B 21/0435; A63B 21/154; A63B 21/155; A63B 21/156
USPC ..... 482/123, 129, 121, 124, 139, 148, 102, 482/91, 99
See application file for complete search history.

(56) References Cited

U.S. PATENT DOCUMENTS 760,374 A * 5/1904 Belvoir ..... 482/129
2,893,736 A 7/1959 Tesi
(Continued)

OTHER PUBLICATIONS

State Intellectual Property Office of the People's Republic of China; Chinese Office Action for corresponding Application No. 20150271075.8 dated Jan. 11, 2017, 2pgs.

*Primary Examiner* — Nyca T Nguyen
(74) *Attorney, Agent, or Firm* — Dinsmore & Shohl LLP

(57) ABSTRACT

An exercise apparatus and method for applying one or more lateral resistive loads to participants performing complex motions at low or high speeds to condition one's body to better and more quickly perform physical movements at high speeds. Elastic members may be used to generate resistance emanating from a ground-based or vertically-positioned apparatus. The elastic members may connect to one or more of the following body parts simultaneously: feet, thighs, waist, hands, elbows or shoulders. The apparatus may be mechanically designed to fully retract the elastic members into the apparatus to maintain resistance while participants are in close proximity to the apparatus. The apparatus may provide a plurality of self-contained elastic members and provides participants with the ability to alter the vertical and horizontal positions of each elastic member's emanation point from the apparatus. This provides the ability to control applied resistance vectors between the attachment point on the participant and the apparatus.

29 Claims, 42 Drawing Sheets

Related U.S. Application Data

(60) Provisional application No. 60/924,964, filed on Jun. 7, 2007, provisional application No. 60/487,227, filed on Jul. 16, 2003.

(51) Int. Cl.
*A63B 23/035* (2006.01)
*A63B 23/04* (2006.01)
*A63B 21/055* (2006.01)

(52) U.S. Cl.
CPC ..... *A63B 21/0552* (2013.01); *A63B 21/4017* (2015.10); *A63B 23/03575* (2013.01)

(56) References Cited

U.S. PATENT DOCUMENTS 3,752,474 A * 8/1973 Macabet et al. ..... 482/131
4,251,071 A * 2/1981 Norton ..... 482/125
4,551,108 A 11/1985 Bass
4,593,909 A 6/1986 Anselmo et al.
4,645,204 A * 2/1987 Berger ..... A63B 21/0004 482/123
4,685,670 A * 8/1987 Zinkin ..... 482/129
4,863,163 A * 9/1989 Wehrell ..... A63B 21/4009 482/123
4,913,423 A * 4/1990 Farran et al. ..... 482/130
4,968,028 A * 11/1990 Wehrell ..... 482/124
5,048,836 A 9/1991 Bellagamba
5,050,871 A 9/1991 Douglas et al.
5,242,339 A 9/1993 Thornton
5,451,194 A 9/1995 Harrigan
5,468,205 A * 11/1995 McFall et al. ..... 482/129
5,512,029 A 4/1996 Barnard et al.
5,540,642 A 7/1996 Sprague
5,586,962 A * 12/1996 Hallmark ..... A63B 21/04 482/123
5,597,376 A 1/1997 Bode et al.
5,653,665 A 8/1997 Neeley
5,803,822 A 9/1998 Pursell
5,924,933 A 7/1999 Pacheco
5,941,807 A 8/1999 Cassidy et al.
6,106,444 A * 8/2000 Maingart ..... 482/95
6,120,418 A 9/2000 Plough
6,123,649 A * 9/2000 Lee ..... A63B 21/153 482/51
6,220,994 B1 4/2001 Rich
6,267,711 B1 * 7/2001 Hinds ..... 482/121
6,554,747 B1 4/2003 Rempe
6,612,845 B1 9/2003 Macri et al.
6,634,998 B2 10/2003 Siaperas
6,652,427 B2 * 11/2003 Wroclawsky ..... 482/111
6,726,606 B2 * 4/2004 Jacobsen ..... 482/121
6,966,870 B2 11/2005 Lan
7,591,763 B1 * 9/2009 Fucci ..... A63B 21/0552 482/121
9,199,110 B2 * 12/2015 Jones ..... A63B 5/16
2003/0158024 A1 * 8/2003 Saure ..... 482/126
2005/0032613 A1 2/2005 Wehrell
2005/0043156 A1 2/2005 Wehrell
2006/0128540 A1 * 6/2006 Engle ..... A63B 21/04 482/123
2006/0199706 A1 9/2006 Wehrell
2008/0248933 A1 * 10/2008 Suiter ..... A63B 21/0552 482/122

* cited by examiner

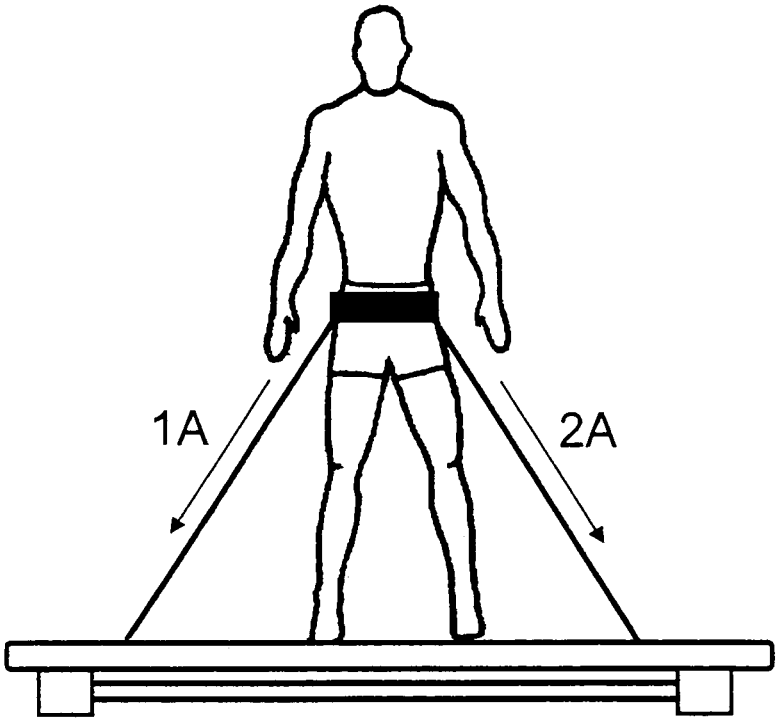
Figure 4 - Front View
PRIOR ART
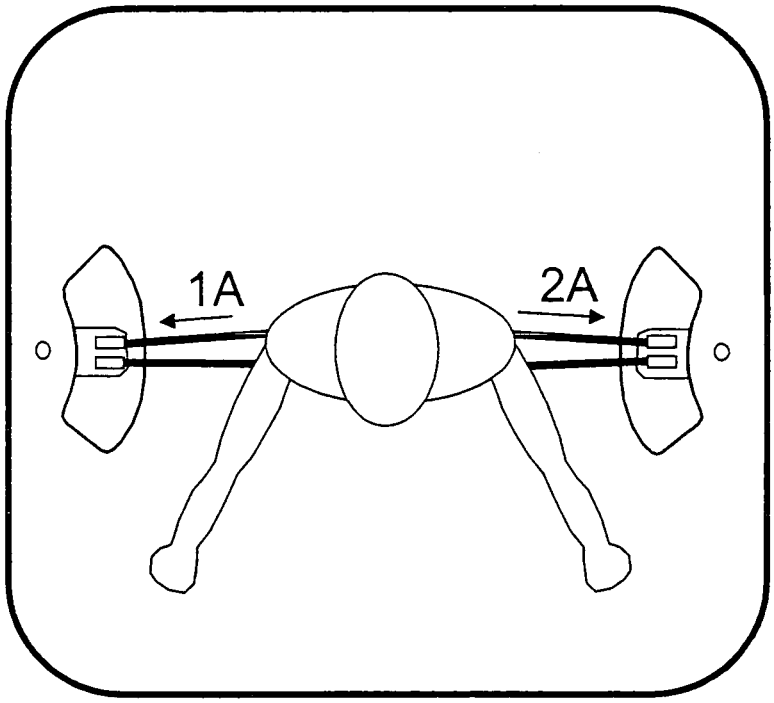
Figure 5 - Top View
PRIOR ART

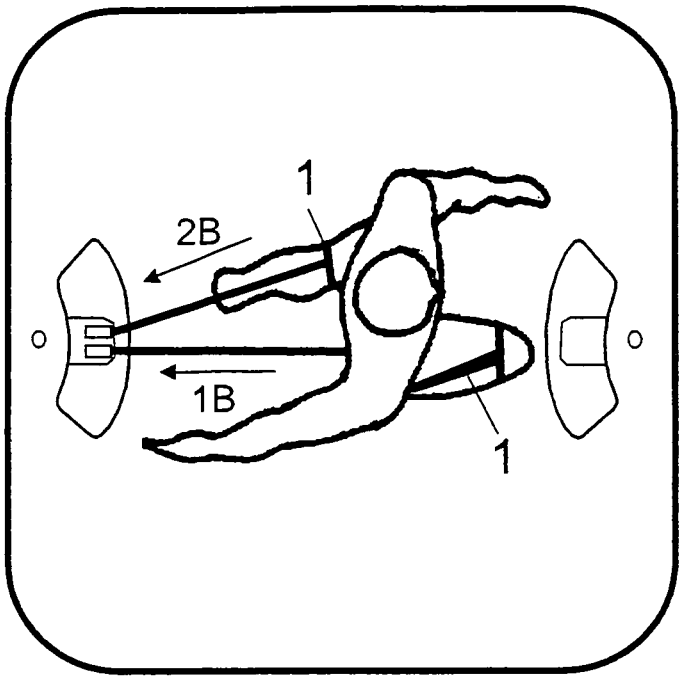
Figure 8 - Top View
PRIOR ART
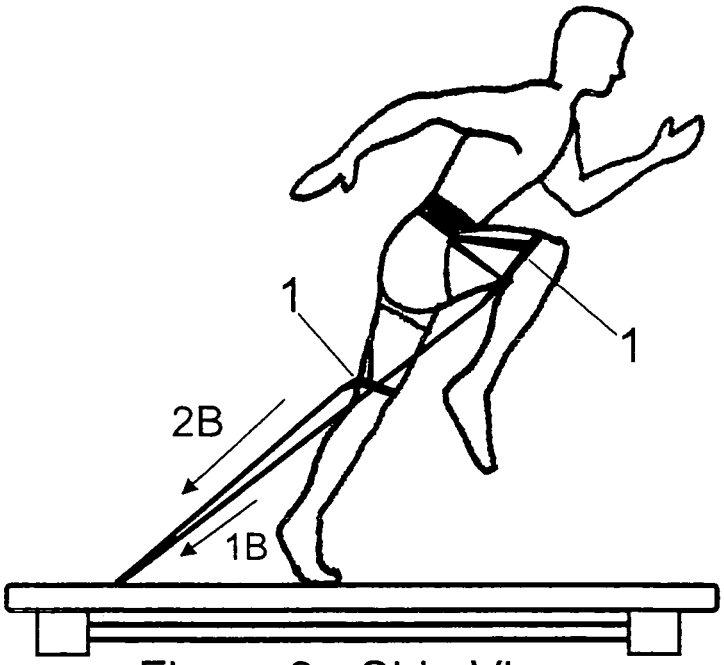
Figure 9 - Side View
PRIOR ART

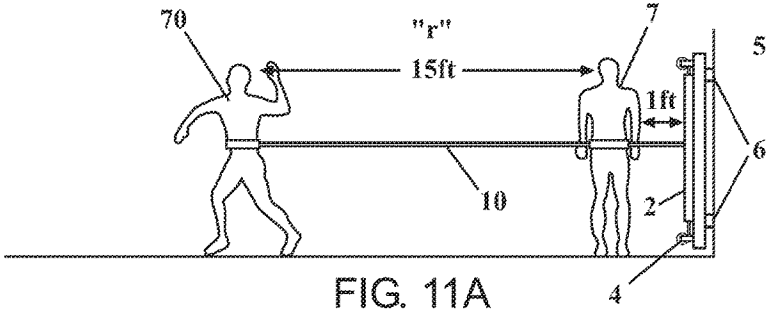
FIG. 11A
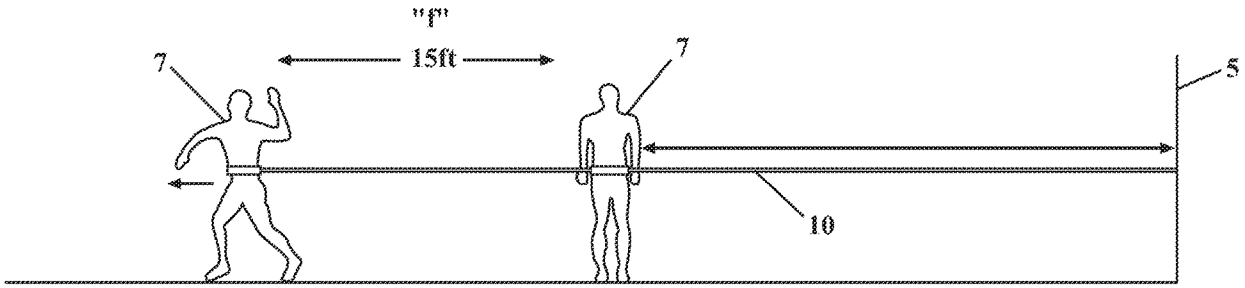
FIG. 11B "Prior Art"
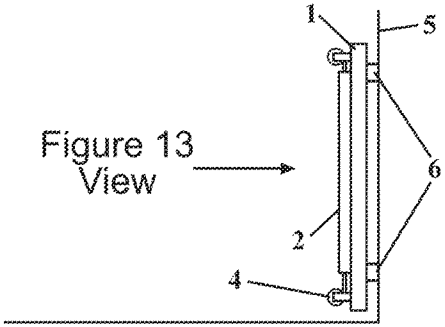
FIG. 12

FIG. 20 (Side View)

7
9
1C
1A
1

7
9
1C
1A
2C
2A
1

7
9
1A
1C
2

7
9
1A
1C
2C
2A
1

7
9
2A
1A 9
1B
2A
1
2
2B
60

1A
2A
2
1B
2C
62
61
60
2B

LATERAL TRAINING SYSTEM AND METHOD

CLAIM OF PRIORITY

The instant application is with and claims the priority benefit of U.S. Provisional Patent Application Ser. No. 60/924,964 filed Jun. 7, 2007. The instant application is also a continuation-in-part of co-pending U.S. patent application Ser. No. 10/892,568 entitled "Physical Training Apparatus and Method," filed Jul. 16, 2004, by the inventor hereof, which claims the priority benefit of U.S. Provisional Patent Application Ser. No. 60/487,227 filed Jul. 16, 2003, the contents of each are incorporated by reference herein.

RELATED APPLICATIONS

The instant application is related to U.S. patent application Ser. No. 10/892,196 entitled "Swing Training Apparatus and Method," filed Jul. 16, 2004, by the inventor hereof, the contents of which are incorporated by reference herein. The instant application is related to U.S. patent application Ser. No. 11/364,181 entitled "Physical Training Apparatus and Method" filed Mar. 1, 2006, by the inventor hereof, the contents of which are incorporated by reference herein.

BACKGROUND

The present invention relates to a lateral training apparatus and method for training persons such as trainees, athletes and others to improve various motor skills. More particularly, it relates to a lateral training apparatus and method for providing forces of either constant or varying magnitude opposing the motion of a single or multiple points on the body of a trainee while performing slow or high speed movements.

Physical training and conditioning have long been recognized as desirable for improving various motor skills to improve the performance of an athlete, the rehabilitation of a physical therapy patient, or the overall physical well-being of the trainee. Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

For example, if an athlete wants to run faster it has been found to be more beneficial to apply light resistance to the leg muscles while running than by performing a press with the legs with heavy weights. Both of these training methods will strengthen the leg muscles of the athlete, however, the high-speed training by providing light resistance while running allows the athlete to generate more power at high speeds since the muscle is conditioned with resistance at high speeds. Training the muscles using slow movement with resistance promotes power generation at slow speeds since the muscle is conditioned at slow speeds. Both training methods are important to most athletes. For athletic performance optimization at high speeds, however, the muscles must be physically and neurologically trained at high speeds. The term "training vector" as used herein shall mean a force opposing the motion of a portion of a trainee through a predetermined range of motion. The magnitude and direction of a training vector may be relatively constant or may vary through a predetermined range of motion.

Many sports related movements involve multiple muscle groups moving multiple body parts simultaneously to perform the specific movement. For example, when an athlete jumps he or she uses the legs, back and arms simultaneously. To optimize training for a particular movement it is beneficial to train using a natural jumping motion while applying resistance to the legs, back and arms simultaneously. Such an exercise method would be more effective than methods where resistance is only applied to the legs because it allows major muscle groups used in jumping to be fired in the proper neurological sequence with applied resistance.

Further, it has been discovered that exercise methods applying resistance during sports specific motions and speeds provide an effective and highly efficient means to develop power and motor reflexes in the human body thereby conditioning the body to perform the specific motions more effectively and quickly. Since high speed resistive training generally requires an athlete to accelerate and decelerate at high speeds, light-weight elastic members may be preferable to supply appropriate resistance. Elastic members provide little mass and may be attached to and allow a trainee such as an athlete to quickly accelerate and/or decelerate against a training or force vector possessing a magnitude that changes little regardless of the speed at which the trainee is accelerating or decelerating. Training resistance generated by a weighted means as opposed to elastic members is undesirable as weights provide inertia and therefore require significantly more force to accelerate and decelerate. For example, the energy required to accelerate a ten pound weight in a human hand at 10 m/s is more than one-hundred times more than the energy required to accelerate the distal end of a twenty foot elastic member at 10 m/s attached to a human hand applying ten pounds of force. In embodiments of the present subject matter, no energy is required to decelerate the distal end of the same elastic band moving at 10 m/s; conversely, considerable force would be required to decelerate the ten pound weight moving at 10 m/s. Thus, the high resistance to mass ratio of exemplary elastic members makes associated exercise apparatuses an ideal means to apply training vectors to trainees who are desirous of conducting high speed resistance training.

High speed athletic movements during competition are performed against gravity and an athlete's own mass (accelerating or decelerating body and limbs). A trainee's mass and gravity do not change when the trainee is attempting to accelerate or decelerate on a field of play. Thus, the resistance a trainee feels when attempting to accelerate or decelerate on the field of play does not change as the trainee works to accelerate or decelerate. It is therefore paramount in an exercise apparatus that when a trainee conducts high speed resistance training, the resistance also remains relatively constant through the acceleration and deceleration phase of the athletic movement or exercise. In contrast, if applied training resistance varies rapidly during the acceleration and deceleration phases of the athletic movement or exercise, the trainee's balance and ability to maintain a sports specific exercise movement will be severely disrupted because the rapidly varying resistance simulates a change in mass and/or gravity during the movement. This shortcoming of the prior art is unnatural, and humans are not inherently trained or bio-mechanically designed to deal with such variances when training at high speeds.

The advantageous physical characteristics of elastic members coupled with the need to apply relatively constant resistance for high speed training through a longer distance has lead to the widespread use of long elastic members (e.g., 4 to 30+ feet) for sports specific speed training and power resistance training. Further, the longer an elastic member, the farther an athlete may stretch the member before the member's resistance to stretching increases (generally at an exponential rate). For example, if an athlete extends a 4 foot elastic member to 8 feet, the resistance measured when the member reaches 8 feet will likely increase 200 or 300 percent relative to the resistance measured at 4 feet just as the member was tightened. If, however, an athlete extends a 50 foot elastic member 4 additional feet to 54 feet, then the additional 4 foot length represents a small fraction of the total relaxed member length, and the resistance measured at 54 feet will be a few percent greater than at 50 feet.

The implementation of long elastic members to provide constant resistance for high speed sports specific training in the prior art, however, is generally both functionally and spatially inefficient. For example, when a long elastic member is anchored at one end and attached to a trainee on the distal end, the trainee must walk away from the anchor point until the elastic band becomes taut and then walk further away stretching the elastic member until the trainee feels the desired applied resistance. The trainee may then perform the desired sports training movement. This deficiency in the prior art creates the following four problems.

(1) In the prior art, a large exercise space is generally required to accommodate the long elastic member. FIG. 1 is a side view of a prior art exercise apparatus with a trainee in various positions showing a restraining means providing a specified resistance with reference to the trainee. With reference to FIG. 1, in Phase 1 a trainee using a 25 foot elastic member attached to his or her waist has no load applied to their body when less than 25 feet from an anchor point "A." In Phase 2 of FIG. 1, the trainee must move 25 feet away from the anchor point before the slack is removed from the member and any resistance is felt by the trainee. In Phase 3 of FIG. 1, the trainee must move an additional 5 feet (in this example) away from the anchor point to stretch the member and set/create a desired starting resistance for the exercise. In Phase 4 of FIG. 1, the trainee then performs a desired exercise movement moving another 15 feet from the anchor point plus an additional 5 feet to decelerate. Thus, in the prior art the required exercise space for this example is approximately 45 feet. Embodiments of the present subject matter, however, eliminate the spatial requirements of the prior art illustrated in Phases 1 through 3 of FIG. 1.

(2) In the prior art, when attaching the ends of a fixed length elastic member to a trainee and anchor point, training resistance cannot be set independent of the spatial relationship between the trainee and anchor point. With reference to FIG. 2, if a trainee desires to increase the applied resistance by an elastic member 1 to his hand at a point A from 5 pounds to 8 pounds, the trainee must move from 10 feet to 14 feet away from anchor point B. This will stretch the elastic member 1 an additional 4 feet thereby increasing the resistance as the member is stretched the additional length. This has two distinct disadvantages. First, if a trainee desires more resistance at the start of the exercise, the trainee would need more space to move away from the anchor point to stretch the member and increase resistance. Second, the force vector acting on the hand of the trainee by the elastic member 1 is different at 10 and 14 feet. Therefore, the angle of the force vector acting on the body given a fixed anchor point will change as the trainee changes his position relative to the anchor point. This deleterious effect in the prior art is obviated by embodiments of the present subject matter.

(3) In the prior art, elongated elastic members make it difficult to apply a desired force or training vector to a trainee throughout the full range of an exercise or complex sports specific movement.

(4) In the prior art, attempting to maintain independent control of applied resistance from multiple force or training vectors generated by utilizing multiple elastic members is difficult as the resistance of all members is increased through the movement of a trainee away from the anchor point. FIG. 3 provides a pictorial illustration of this limitation of the prior art. In the prior art, if the trainee wants to increase the resistance applied to the hand by an elastic member 1 at Position 1 while being satisfied with the resistance applied to the waist by another elastic member 2 at Position 1, the trainee would have to move further away from the anchor point B of the elastic member 1 to Position 2. This movement to Position 2 would additionally stretch the other elastic member 2 thereby applying more resistance to the waist when additional resistance to the waist was not desired. Again, this undesirable effect in the prior art is obviated by embodiments of the present subject matter.

U.S. Pat. Nos. 4,968,028 and 4,863,163 entitled "Vertical Jump Exercise Apparatus" issued to the inventor of the present subject matter each disclose resistance training apparatus for vertical jump training and conditioning. The prior art system disclosed in the Wehrell patents illustrated in FIGS. 4 through 9, applies two training vectors having relatively constant magnitude to the hips of the trainee (see FIGS. 4 through 7 showing training vectors 1A and 2A) for applying resistance to the legs while performing a jumping motion.

A later modification of the exercise apparatus disclosed in the Wehrell patents is shown in FIGS. 8 and 9. In this embodiment, the training vectors 1B and 2B provide relatively constant resistance to the back of the knees of a trainee performing a running motion by attaching the elastic members of the exercise apparatus to detachable leg harnesses 1 worn by the trainee. This embodiment provided resistance for training the hip flexors of the trainee at high speeds.

There is, however, a need in the art to implement more complex high speed training configurations where resistance is applied to multiple body parts simultaneously. There is also a need in the art to attach or apply multiple lateral resistance vectors to a trainee while allowing: (1) the resistance of each elastic member to be set independently of one another without regard to the spatial relationship between the trainee and the respective elastic member anchor points; (2) an ability to easily manipulate the anchor point of each elastic member in more than one dimension to thereby control the direction of the applied resistance or training vector when the elastic member is attached to a trainee; (3) an ability to set a desired resistance applied to a trainee in close proximity (e.g., one foot or less) to the exercise apparatus or to a trainee at a considerable distance from the apparatus; (4) an ability to simultaneously provide multiple (e.g., 2 to 8 or more) training vectors with an upward and/or downward resistance component, each of which may provide the abilities enumerated in (1) through (3) above.

Therefore, one embodiment of the present subject matter provides one or more resistance training vectors to one or more trainees simultaneously. Another embodiment of the present subject matter provides multiple resistance members routed through mechanical mechanisms enabling the resistance members to be contained within the respective exercise apparatus and provide a substantial effective length.

Further embodiments of the present subject matter provide a lateral training apparatus and method for applying training vectors to the hands, thighs and other portions of a trainee's body for providing resistance to multiple muscle groups while performing complex sports specific movements.

One embodiment of the present subject matter provides a lateral training apparatus comprising a vertically oriented base and a means for providing a plurality of training vectors to one or more selected portions of a trainee. The training vectors may provide a relatively constant or varying force to the portion of the trainee through a predetermined range of motion and within a predetermined training area the magnitude of the force is substantially independent of the distance between the trainee and apparatus.

Another embodiment of the present subject matter provides a lateral training apparatus comprising a base being attached to a vertical surface, one or more garments each adapted to be worn by a trainee, and at least one member attached to each garment for providing a training vector opposing the motion of the garment in a predetermined range of motion. The members may provide a resistive force that is relatively constant or varying over the predetermined range. The apparatus may further include a mechanical assembly attached to the base for directing each of the members from the base.

A further embodiment of the present subject matter may provide a lateral training apparatus comprising a hinged base having a horizontal portion forming a substantially planar training surface and a vertical portion. The apparatus may further comprise a mechanical assembly attached to the hinged base for directing plural members from the hinged base to one or more garments worn by a trainee. The members provide a training vector opposing the motion of the garment in a predetermined range of motion.

Another embodiment of the present subject matter provides a lateral training apparatus comprising a hinged base having a first portion forming a substantially horizontal planar surface and a second portion forming a substantially vertical planar surface, and a plurality of means for providing training vectors to a trainee. One of the means may be removably attached to the horizontal portion and another of the means may be removably attached to the vertical portion. The vector origin location of each of the means may also be variable in the respective planar surface defined by the first and second portions.

An additional embodiment of the present subject matter provides a lateral training apparatus comprising a base forming a substantially planar vertical surface and a mechanical assembly attached to the base for directing each of one or more members from the base to a garment worn by a trainee. The member provides a training vector opposing the motion of the garment in a predetermined range of motion and the magnitude of each of said training vectors is selectively adjustable by a resistance mechanism.

Yet another embodiment of the present subject matter provides a lateral training system comprising a first hinged base having a first portion forming a first planar surface and a second portion forming a second planar surface, and a plurality of means for providing training vectors to a trainee. The system further includes a second hinged base having a first portion forming a third planar surface and a second portion forming a fourth planar surface, and a plurality of means for providing training vectors to the trainee. Any one of the means may being removably attached to the first or second portions of the first or second bases, and the horizontal components of the training vectors provided by the first and second hinged bases may be applied to the trainee in opposite directions.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 4 is a front view of a prior art exercise apparatus with a trainee in a standing position showing a restraining means providing a specified resistance with reference to the trainee.

FIG. 5 is a top plan view of the prior art exercise apparatus of FIG. 4.

FIG. 8 is a top plan view of a prior art exercise apparatus with a trainee performing a running motion showing a restraining means providing a specified resistance with reference to the trainee.

FIG. 9 is a side view of the prior art exercise apparatus of FIG. 8.

FIGS. 11A-11B illustrate a pictorial representation of an advantage provided by an embodiment of the present subject matter.

FIG. 12 illustrates a point of view for a wall-mounted lateral training apparatus according to an embodiment of the present subject matter.

DETAILED DESCRIPTION OF THE DRAWINGS

With reference to the figures where like elements have been given like numerical designations to facilitate an understanding of the present subject matter, the various embodiments of a lateral training apparatus and method are described.

According to one aspect of the present subject matter, a lateral training apparatus and method are provided for providing multiple training vectors to a trainee such as an athlete while performing various athletic or therapeutic movements.

Figure 10A:
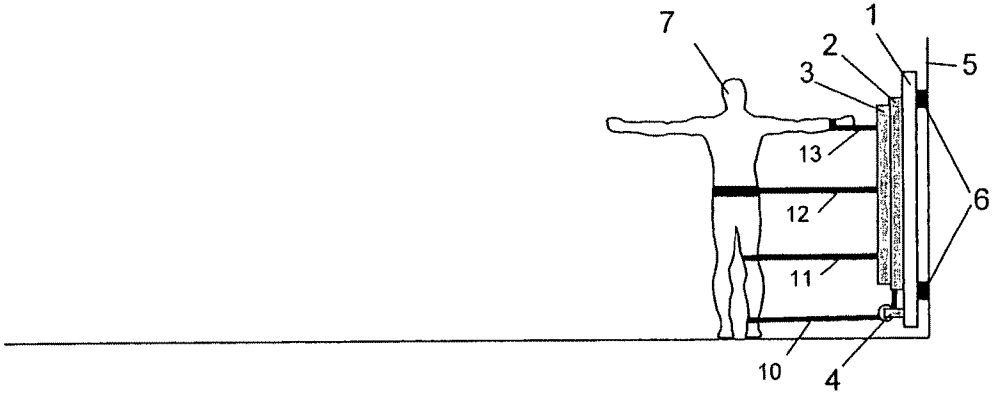
FIGS. 10A-10C illustrate a lateral training apparatus according to one embodiment of the present subject matter.
Figure 10B:
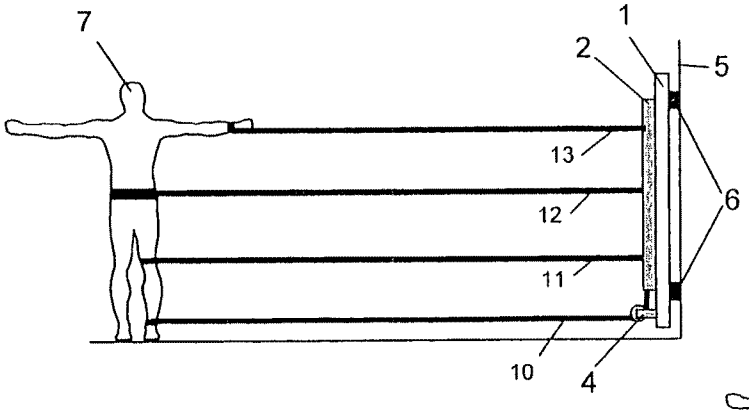
Figure 10C:
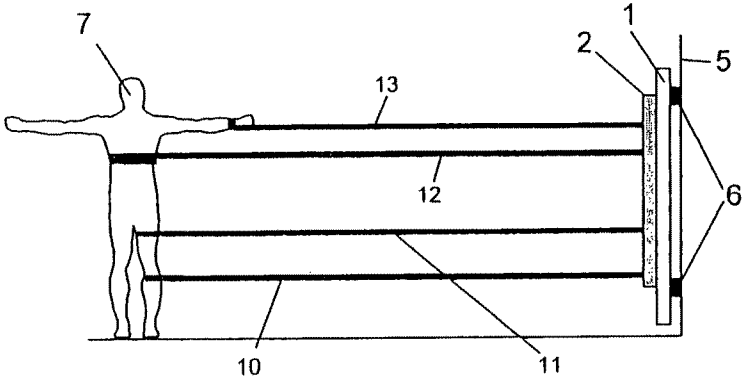

FIGS. 10A-10C illustrate a lateral training apparatus according to one embodiment of the present subject matter. With reference to FIGS. 10A-10C, a lateral training apparatus 100 may comprise a planar base 1 attached to a wall 5 or other vertical plane via fasteners 6, such as bolts, screws, or the like. One or more mechanical assemblies 2, 3 or training modules, such as those disclosed in application Ser. No. 10/892,568 entitled "Physical Training Apparatus and Method," filed Jul. 16, 2004, the entirety of which is incorporated herein by reference, may be individually or severally attached to the base 1. The assemblies 2, 3 may include one or more elongated elastic members 10-13, such as elastic bands, routed through plural tracking assemblies (not shown), such as pulleys, therein. In one embodiment the tracking assemblies may be mounted directly to portions of the base 1. In another embodiment, the tracking assemblies may be mounted to a rigid frame of the assemblies 2, 3. One end of each elastic member 10-13 may be attached to an exemplary anchor (not shown), such as a cam cleat, to alter the resistance of a respective elastic member 10 and thus the training vector provided to a trainee 7. For example, one end of an elastic member 10 may be fed through the anchor to increase the resistance or retracted into the assembly 2 to decrease the resistance. While reference has been made to mechanical assemblies 2, 3 having tracking assemblies and the like, such an example should not limit the scope of the claims appended herewith. For example, a lateral training apparatus 100 may include one or more electronic spools, motors or spring-driven, hydraulic or pneumatic apparatuses in place of the mechanical assemblies 2, 3. These spools, motors, etc., may provide a selectively and/or electronically controlled resistance for a trainee via members routed or directed therefrom.

In embodiments employing mechanical assemblies 2, 3, the anchor on each assembly may enable the effective length of the elastic member(s) in the assembly to be varied to thereby increase or decrease the magnitude of the force provided by the member. The range of variance is limited by the diameter of the elastic member. For example, the assembly may include an elastic member with a diameter of ⅜ inches. The effective length of the elastic member may be varied to thereby vary the force provided by the elastic member in the range between about twenty and about forty pounds. By adding a second assembly including an elastic member with a smaller diameter resistance band (e.g., a diameter of about 5/16 inches) would provide a useful resistance force range from about four to about twenty pounds. By adding another assembly including an elastic member with a larger diameter (e.g., a diameter of ½ inches) would provide a useful resistance force range from about thirty-five to about sixty pounds. Thus, by adding multiple assemblies the effective range of resistance forces is expanded to the range between about four pounds to about sixty pounds. Without the ability to attach and detach additional assemblies, one would have to remove and then completely replace the resistance band to provide a lower or higher range of training resistances. One or more assemblies 2, 3 may be individually and removably fastened to the base 1 or may be stacked to one another in vertical and/or horizontal configurations. In one embodiment, the base 1 may provide attachment areas for eight mechanical assemblies 2, 3. Mechanical assemblies 2, 3 may also provide for additional attachment means (e.g., Velcro straps, clamps, pegs, etc.) to thereby provide additional functionality to the apparatus 100. For example, one or more mechanical assemblies 2, 3, may be detached from the base 1 and attached to a fence, door or other substantially vertical or angled surface to allow athletic movement and exercises in another environment. Each elastic member 10-13 that attaches to a trainee 7 may pass through a movable or slidable pulley assembly 4 attached to the base 1. The pulley assembly 4 may thus allow movement of the origin of the respective training vector applied to the trainee 7 via the elastic member 10. One embodiment of the pulley assembly 4 may include a pivoting and rotating pulley mounted on a base that is slidably carried by a track. The position of the assembly 4 may be fixed by any suitable locking means such as a spring loaded locking pin.

FIG. 10B illustrates a trainee 7 at a considerable distance from the apparatus 100 having multiple elastic members 10-13 providing training vectors for high or low speed athletic movements. FIG. 10C illustrates another embodiment of the present subject matter having different originations of the training vectors provided by the elastic members 10-13.

FIGS. 11A-11B illustrate a pictorial representation of an advantage provided by an embodiment of the present subject matter. For example, FIG. 11A illustrates an improvement in the reduced space considerations for a trainee training under relatively constant resistance as compared to the prior art apparatus illustrated in FIG. 11B. With reference to FIG. 11B, a 25 foot elastic member 10 is attached to a wall 5 at one end and to a trainee 7 at the distal end thereof. To obtain any resistance from the elastic member 10, the trainee 7 must position himself 25 feet from the wall 5 (i.e., the anchor position). The trainee 7 may then move to a second position 15 feet away at low or high speed while the elastic member 10 applies a resistance. The distance between the first position and the second position is the operational range "r". With reference to FIG. 11A, a comparable 25 foot elastic member 10 may be coiled within a mechanical assembly 2 by tracking assemblies, attached at one end to an anchor and to a trainee 7 at the distal end thereof. The length of the elastic member coil within the mechanical assembly being the constant length "C". To obtain resistance from the elastic member 10, the trainee 7 may position himself at any distance from the apparatus 100, in this case 1 foot, and may then move the same 15 feet or operational "range" "r" to be subjected to a relatively similar resistance profile as the trainee 7 illustrated in FIG. 11B. However, the prior art apparatus illustrated in FIG. 11B requires a much greater amount of linear space for the athletic movement. Since the operational distance of FIG. 11A is 15 feet, it is approximately 60% of the constant length. FIGS. 11A and 11B also illustrate the unique ability of embodiments of the present subject matter to set training resistances at variable distances from the apparatus while dramatically reducing the required exercise space by eliminating the need to continually step away from the anchor point of the respective elastic member of the prior art until the long elastic resistance band becomes taut and applies the desired resistance. Therefore, embodiments of the present subject matter may provide training vectors to a trainee having a magnitude that is substantially independent of the distance of the trainee from the apparatus within a predetermined training area. Further, embodiments of the present subject matter may provide training vectors to a trainee having a magnitude that is substantially independent of the acceleration or deceleration of the trainee from the apparatus within a predetermined training area.

Figure 13:
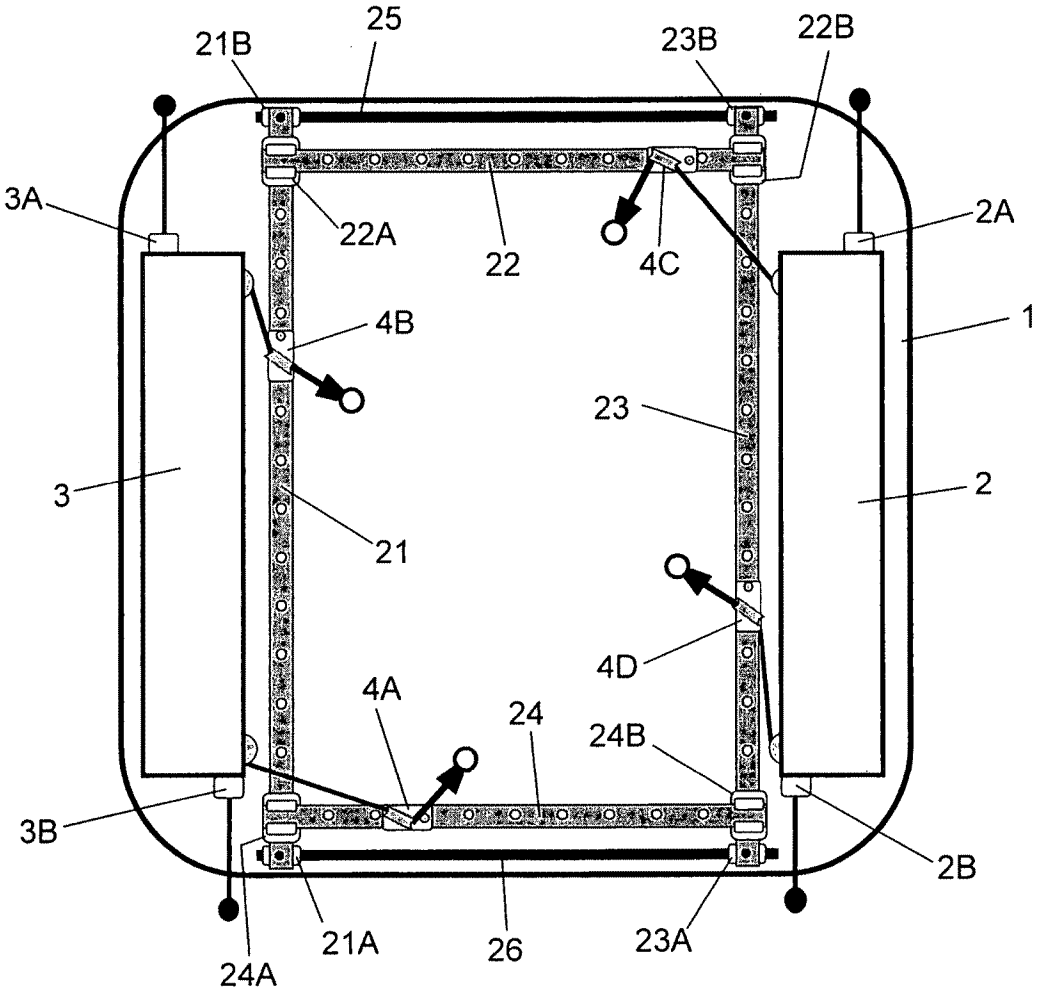
FIG. 13 is a lateral training apparatus according to an embodiment of the present subject matter from the point of view illustrated in FIG. 12.

FIG. 12 illustrates a point of view for a lateral training apparatus according to the embodiment of the present subject matter illustrated in FIG. 13. With reference to FIG. 13, a lateral training apparatus 100 may provide plural mechanical assemblies 2, 3 fixed on the upper surface of the base 1. In another embodiment, the mechanical assemblies may be replaced by plural tracking mechanisms or pulleys with elastic members routed therethrough. The apparatus 100 may also provide plural rail assemblies 21-24 upon which pulley assemblies 4A-4D may be slidably connected to allow their position to be set anywhere along the rail assemblies 21-24. Thus, the point of origin of the training vectors provided by the elastic members 10-13 may be moved along the rail assemblies 21-24.

For example, the rail assemblies 21, 23 may slide along a plane parallel the plane formed by the base 1 by movement along guide rails 25, 26. The rail assemblies 21, 23 may be slidably connected to the guide rails 25, 26 using sliding connectors 21A, 21B and 23A, 23B. The sliding connectors may provide suitable locking mechanisms, such as a spring-loaded locking pin, to lock a respective rail assembly 21, 23 in place once a desired position has been selected by a trainee 7. The rail assemblies 22, 24 may also slide along a plane parallel the plane formed by the base 1 by movement along rail assemblies 21, 23 utilizing bi-directional sliding and locking mechanisms 22A, 22B and 24A, 24B. The ability of embodiments of the present subject matter to reposition rail assemblies 21-24 along the base 1 allows repositioning of the point of origin of training vectors provided by the elastic members 10-13 to a trainee.

In one embodiment of the present subject matter, the mechanical assemblies 2, 3 may each provide two elastic members 10-13 emanating therefrom. One end of each elastic member 10-13 may be attached to an exemplary anchor 2A, 2B, 3A, 3B, such as a cam cleat, to alter the resistance of a respective elastic member 10-13 and thus the training vector provided to a trainee. Thus, the elastic members 10-13 provide ends that may be extracted through the anchors 2A, 2B, 3A, 3B so that the magnitude of the training vectors provided thereby may be selectively increased by shortening the effective length of the elastic members 10-13. Alternatively, the magnitude of the training vectors may be selectively decreased by increasing the effective length of the elastic members 10-13 by releasing the anchors 2A, 2B, 3A, 3B and allowing the members to retract into the assemblies 2, 3, respectively. The anchors 2A, 2B, 3A, 3B may comprise any means suitable for securing the elastic members such as cleats or cam cleats. For example, the cam cleat may be replaced by a suitable electronic, hydraulic, pneumatic, spring, and/or mechanical resistance mechanism. The "effective" length of the elastic members is the length of the elastic member between the anchor and the end of the member attached to a harness connector, to a garment worn by a trainee, or to a body portion of a trainee. The distal ends of each elastic member 10-13 may be attached to any portion of a trainee's body. For example, the distal end of one elastic member 10 may be removably attached to a harness worn on the thigh of a trainee or athlete, and the distal end of another elastic member 13 may be removably attached to a harness worn on the other thigh of the trainee. The distal end of one elastic member 11 may be removably attached to a glove, strap, handle or harness worn on the hand of the trainee or held by the trainee, and the distal end of another elastic member 12 may be removably attached to a glove, strap, handle or harness worn on the other hand of the trainee or held by the trainee. The trainee may then perform high or low speed athletic movements at varying distances from the apparatus 100. If additional training vectors are desired by the trainee, further mechanical assemblies may be appropriately stacked on the assemblies 2, 3 affixed to the base 1.

Figure 14:
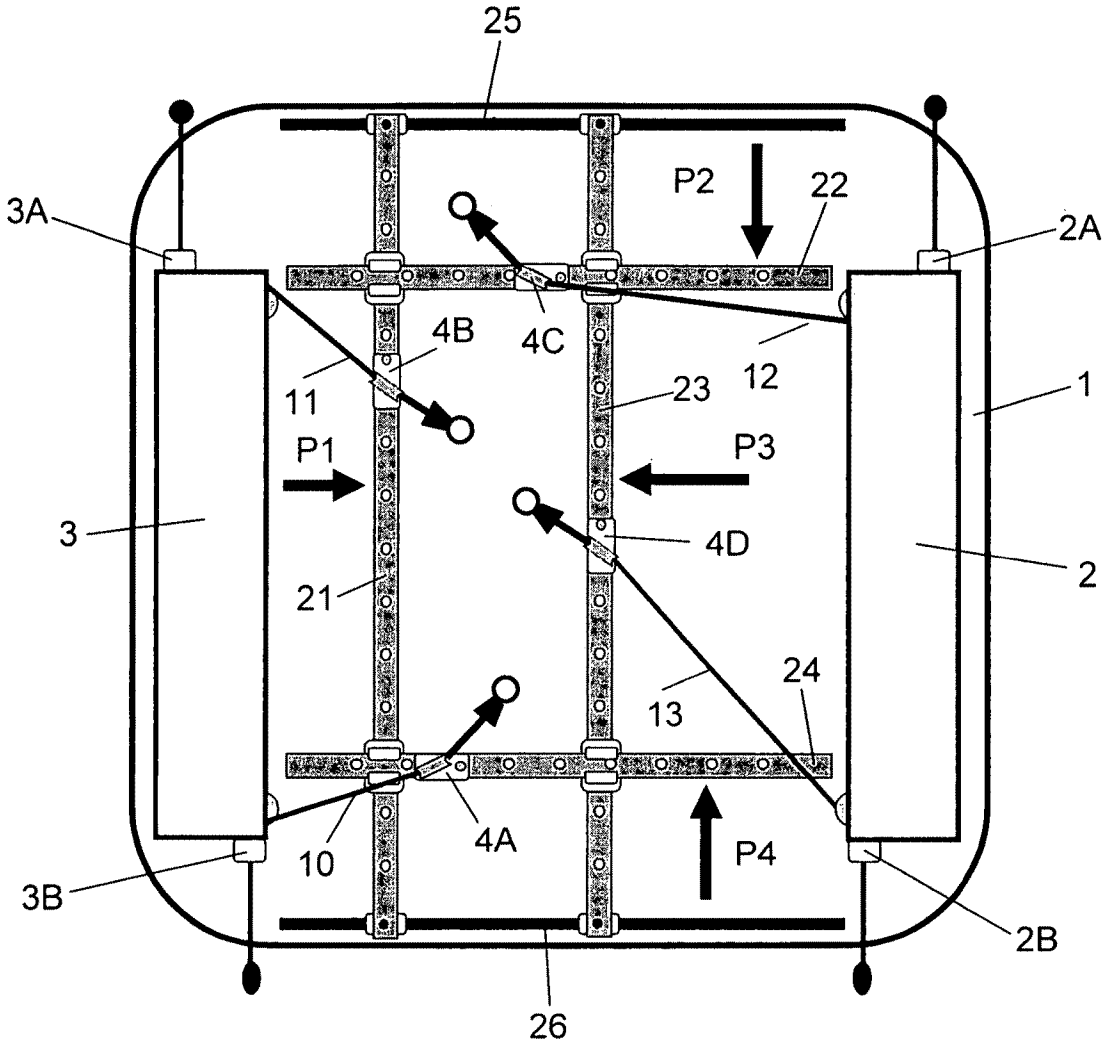
FIGS. 14 and 15 an additional lateral training apparatus according to an embodiment of the present subject matter.
Figure 15:
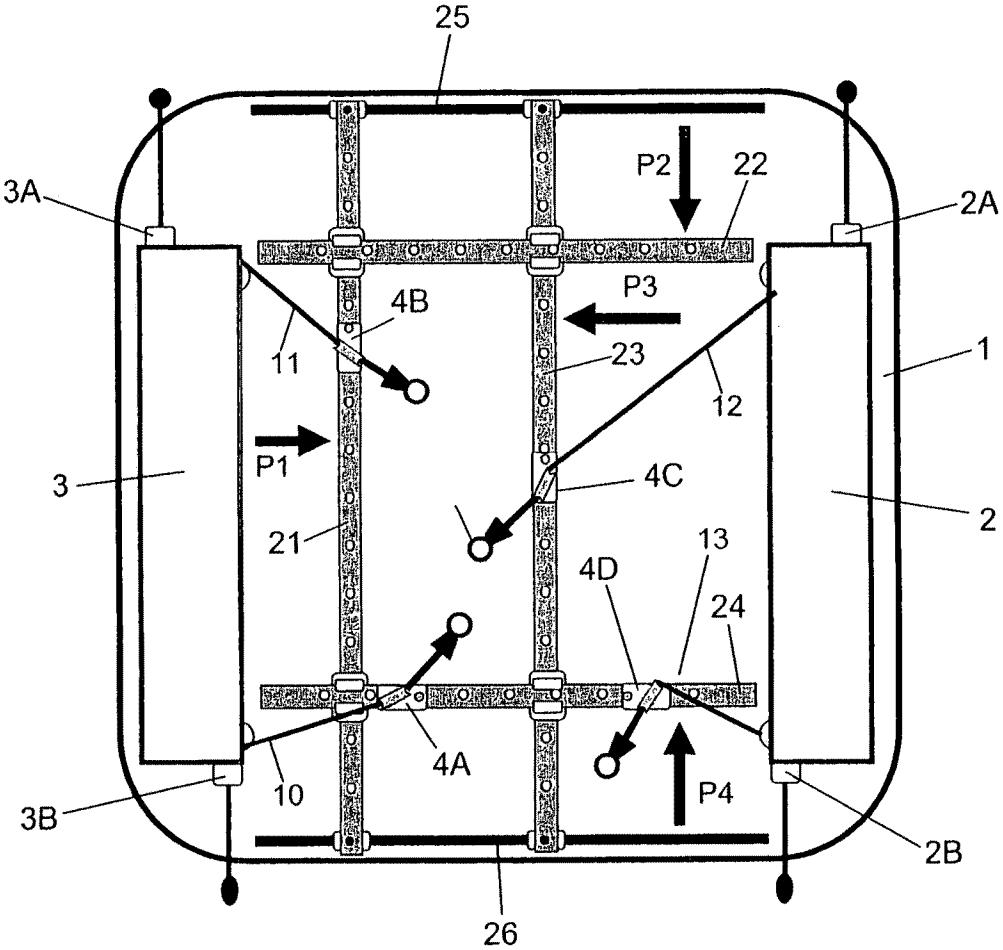

FIGS. 14 and 15 illustrate embodiments of the present subject matter wherein the rail assemblies 21-24 and sliding pulley assemblies 4A-4D may be positioned at various positions relative to the mechanical assemblies 2, 3 as shown by arrows P1, P2, P3 and P4. Thus, the origin of the training vectors from the mechanical assemblies 2, 3 provided to portions of the body of a trainee may be varied in two dimensions along the training surface provided by the base 1. With reference to FIG. 15, more than one sliding or movable pulley assembly may be removably attached to the same rail assembly. For example, pulley assemblies 4A, 4D may be removably attached to the rail assembly 24 and another pulley assembly 4C removably attached to the rail assembly 23 to position the point of origin of training vectors provided by the elastic members 10, 12, 13 to a trainee of the apparatus 100.

Figure 16:
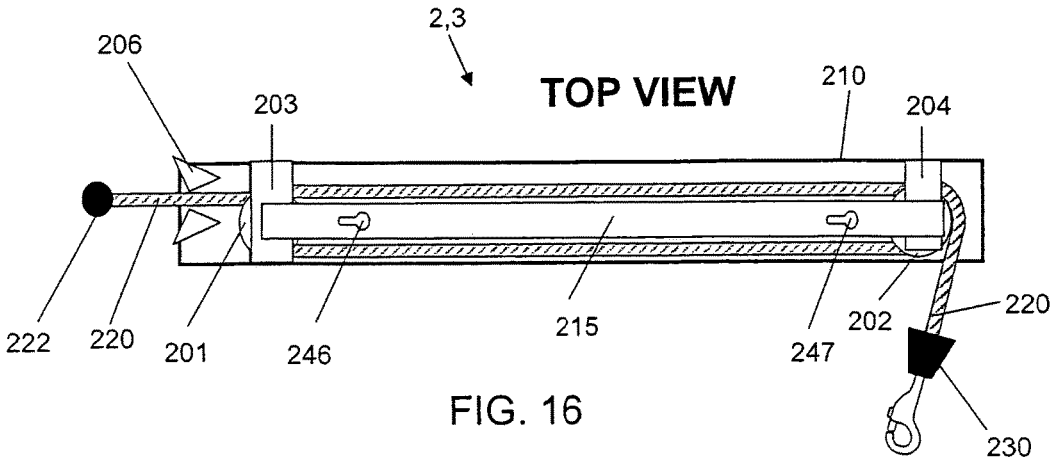
FIGS. 16 and 17 illustrate top and side views of an exemplary mechanical assembly according to an embodiment of the present subject matter.
Figure 17:
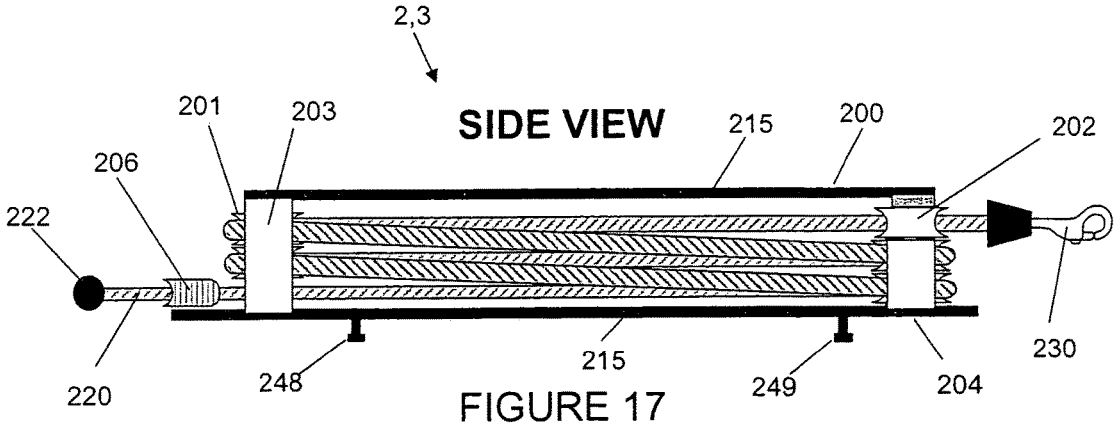

FIGS. 16 and 17 illustrate top and side views of an exemplary mechanical assembly according to an embodiment of the present subject matter. With reference to FIGS. 16 and 17, the mechanical assembly 2, 3 comprises a rigid frame 210 that carries two stacked pulley assemblies 201, 202. Each of the stacked pulley assemblies includes one or more stacked pulleys. As shown in FIG. 17, stacked pulley assembly 201 of two pulleys and stacked pulley assembly 202 of three pulleys. The rigid frame 210 includes upper and lower elongated members 215 and pulley assembly mounting members 203, 204. In one embodiment of the present subject matter, rather than providing a rigid frame, the pulley assemblies 201, 202 may be directed mounted on or carried by the base of the apparatus. A suitable anchor 206 such as a cam cleat is mounted on the lower elongated member 215. The spaced pulley assemblies 201, 202 may provide a path for routing the elastic member 220 therebetween so that an elastic member many times the length of elongated members 215 may be contained within the mechanical assembly 2, 3. The elastic member 220 is secured near one end by the anchor 206 and is attached to a connector 230 at the other end. The effective length of the elastic member 220, i.e., the length of the member between the anchor 206 and the connector 230, may be selected by extracting the end 222 of the elastic member 220 from the assembly 200 and then securing the member 220 with the anchor 206. The magnitude of the training vector will vary with the effective length of the elastic member 220. The connector 230 is adapted to be connected to a harness, garment, glove, or strap worn by the trainee. The elastic member 220 may have sufficient length so that the magnitude of the training vector provided to the trainee wearing the harness is relatively constant through the range of motion of the harness. A single mechanical assembly may also include two or more elastic members having different diameters for providing a wider range of resistive force.

Figure 18:
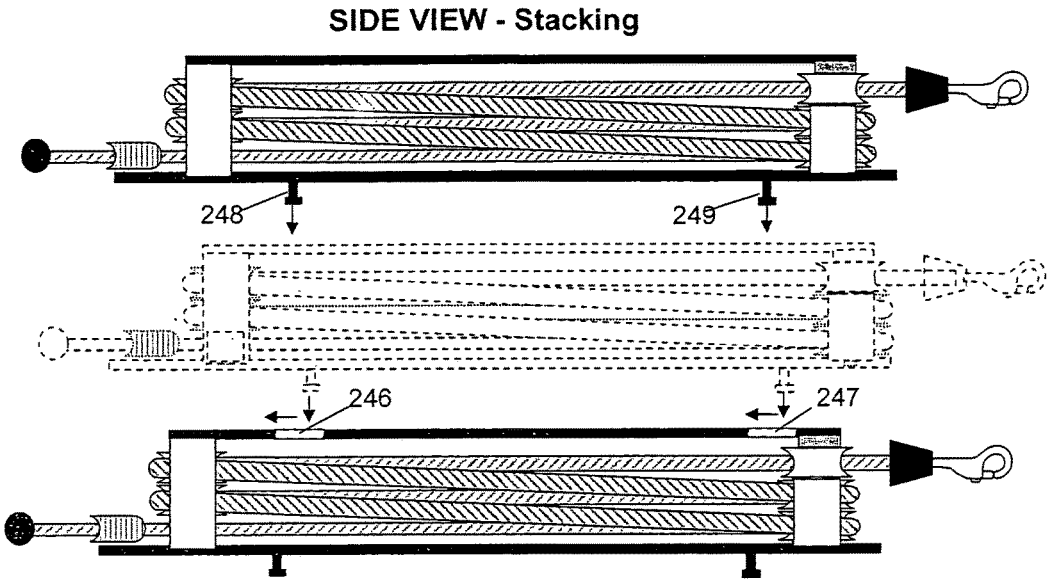
FIGS. 18 and 19 illustrate one means of stacking a plurality of mechanical assemblies.
Figure 19:
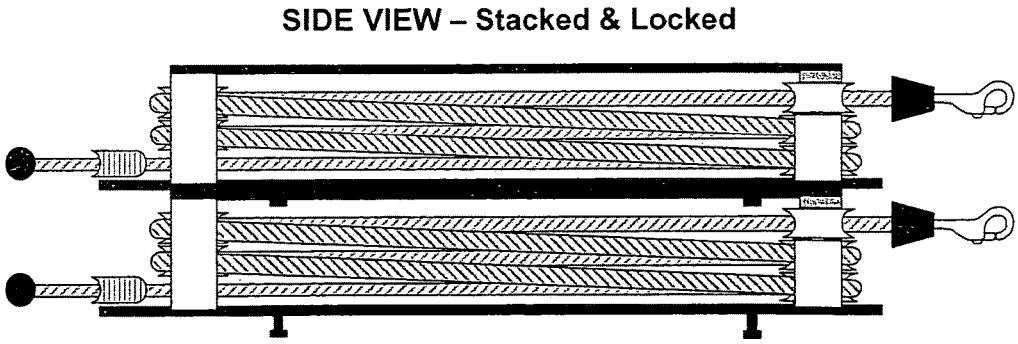

FIGS. 18 and 19 illustrate one means of stacking a plurality of modules 510 or mechanical assemblies. In this embodiment, the upper elongated member 215 includes keyways 246, 247 that are adapted to receive the pegs 248, 249 extending from the lower elongated member of another assembly. The pegs 248, 249 and keyways 246, 247 permit the assembly to be connected to a remote device such as secured module 310. By inserting and locking the pegs of one assembly into the keyways of another assembly, the assemblies may be securely stacked to provide additional training vectors in the lateral training apparatus. The elastic members from each assembly may also be connected to the same harness, glove, etc. or serially connected to each other. The elastic members from each assembly may be the same or different diameters.

Figure 20:
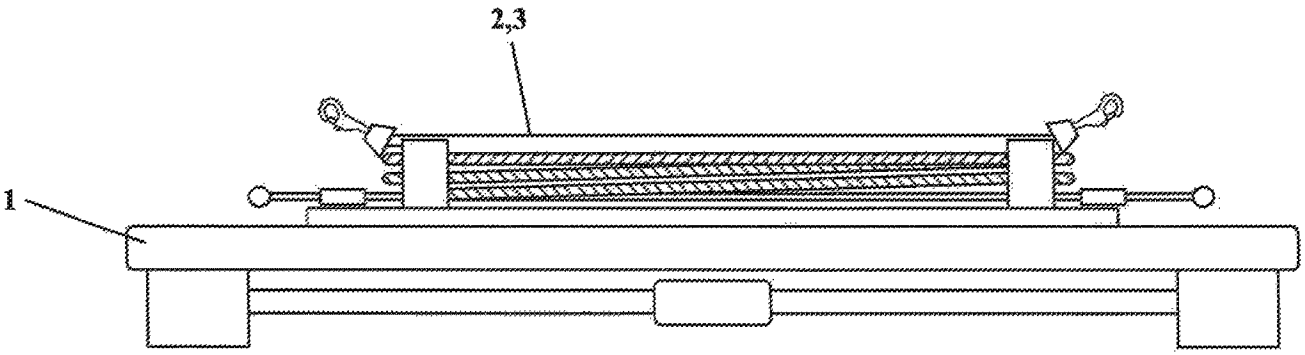
FIG. 20 is a side view of another mechanical assembly according to an embodiment of the present subject matter.

FIG. 20 is a side view of another mechanical assembly according to an embodiment of the present subject matter. A single mechanical assembly 2, 3 may include two elastic members having different or the same diameters for providing different ranges of resistive force. Alternatively, two or more assemblies may be stacked having elastic members with different or the same diameters. The ability to provide a wide range of resistive forces is particularly important in a lateral training apparatus that may be used for training, exercising or rehabilitating trainees ranging from athletes in their prime to the elderly.

Figure 21:
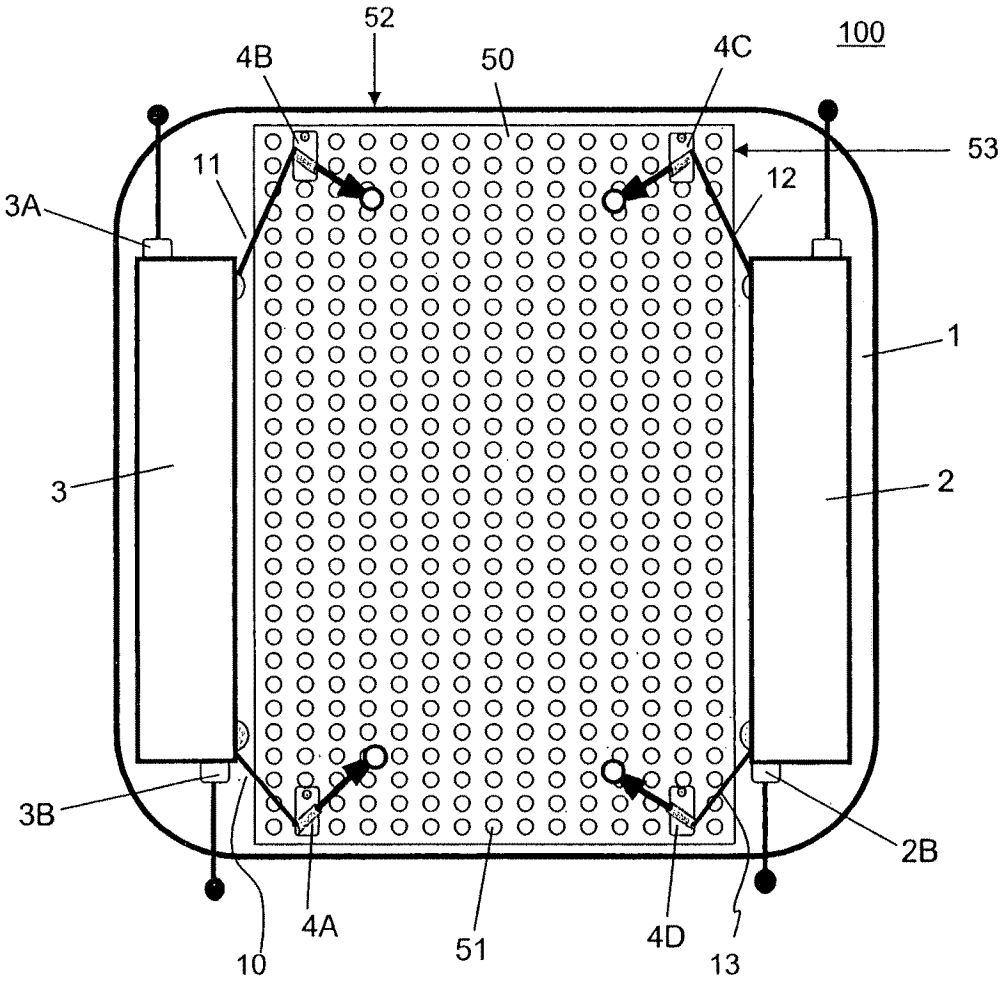
FIG. 21 illustrates another lateral training apparatus according to an embodiment of the present subject matter.

FIG. 21 illustrates another lateral training apparatus according to an embodiment of the present subject matter. With reference to FIG. 21, the lateral training apparatus 100 may provide plural mechanical assemblies 2, 3 fixed on the upper surface of the base 1. The apparatus 100 may also provide a perforated structure 50 comprising a plurality of holes 51 that may or may not be aligned in adjacent columns 52 and rows 53. While the perforated structure 50 may generally represent a pegboard-like structure, such an example should not limit the scope of the claims appended herewith. The perforated structure 50 may be constructed of a strong composite, plastic or metal material and provide the plurality of holes 51 to lock the pulley assemblies 4A-4D in place. The pulley assemblies 4A-4D may provide a suitable locking means, such as locking inserts or spring-loaded pins, allowing a trainee to place and lock the pulley assemblies 4A-4D anywhere on the perforated structure 50 to position the point of origin of training vectors provided by the elastic members 10-13 to a trainee.

Figure 22:
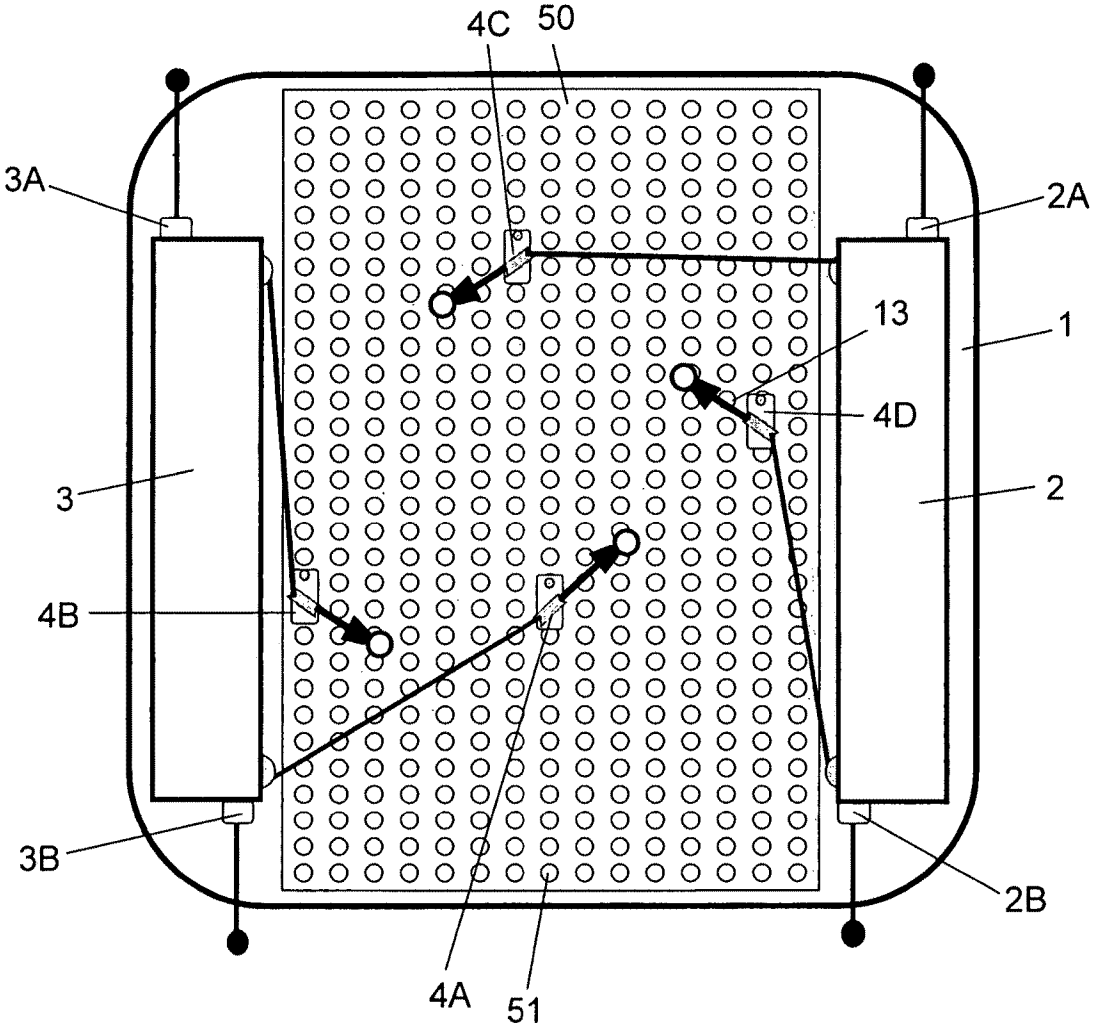
FIG. 22 illustrates a further lateral training apparatus according to an embodiment of the present subject matter.

FIG. 22 illustrates an embodiment of the present subject matter wherein the sliding pulley assemblies 4A-4D may be positioned at various positions on the perforated structure 50 relative to the mechanical assemblies 2, 3. Thus, the point of origin of the training vectors provided by the elastic members 10-13 from the mechanical assemblies 2, 3 provided to portions of the body of a trainee may be varied in two dimensions along the training surface provided by the base 1.

Figure 23:
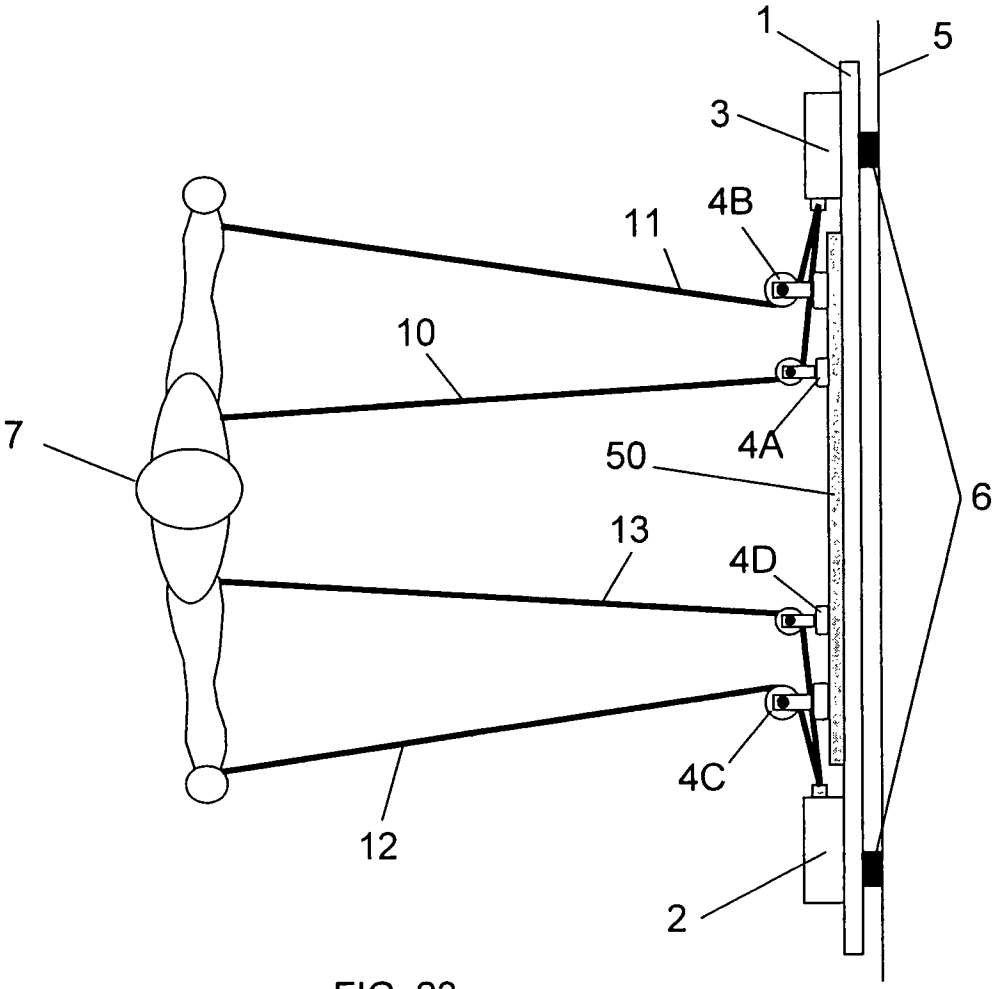
FIG. 23 is a top plan view of an embodiment of the present subject matter.

FIG. 23 is a top plan view of an embodiment of the present subject matter. With reference to FIG. 23, the base 1 of the lateral training apparatus 100 may be attached to a wall or other vertical support structure 5 via fasteners 6 or other attachment means. The various horizontal placements of the training vectors provided by the elastic members 10-13 from the mechanical assemblies 2, 3 provided to portions of the body of a trainee 7 are clearly illustrated.

Figure 24:
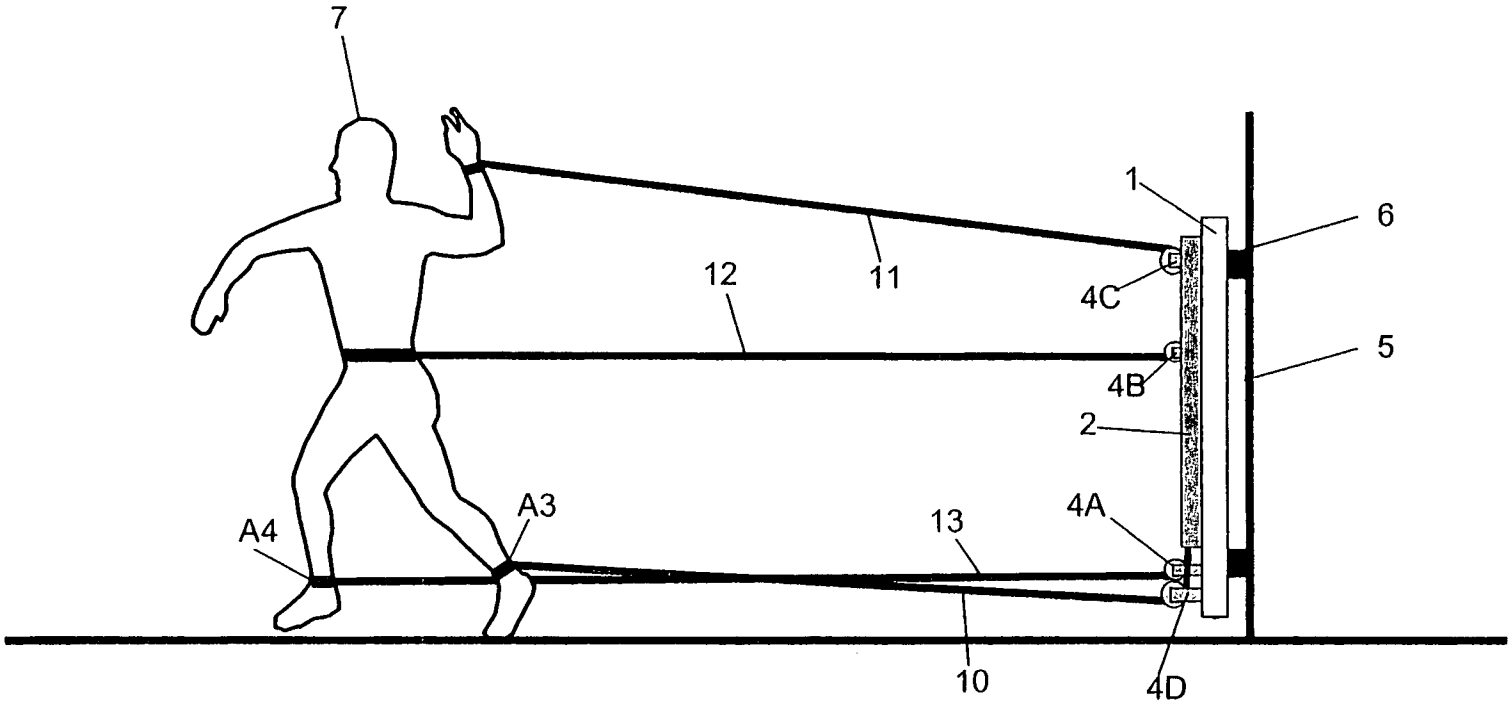
FIG. 24 is a side view of an embodiment of the present subject matter.

FIG. 24 is a side view of another embodiment of the present subject matter. With reference to FIG. 24, the pulley assemblies 4A-4D may be positioned on a perforated structure 50 or moved about rail assemblies 21-24 to configure and alter the point of origin of the training vectors provided by the elastic members 10-13 from the mechanical assemblies 2, 3. In the illustrated example, the trainee 7 is performing a throwing motion (e.g., baseball, football, etc.) and may thus removably attach an elastic member 11 to his throwing hand or arm, elastic members 10, 13 to his legs, and an elastic member 12 to his waist. The elastic members 10-13 may be attached to straps, harnesses, gloves or the like worn or straps and handles held by the trainee 7 or may be attached to garments, shoes, etc., worn by the trainee.

Figures 25, 26, 27, 28, 29, 30, 31:
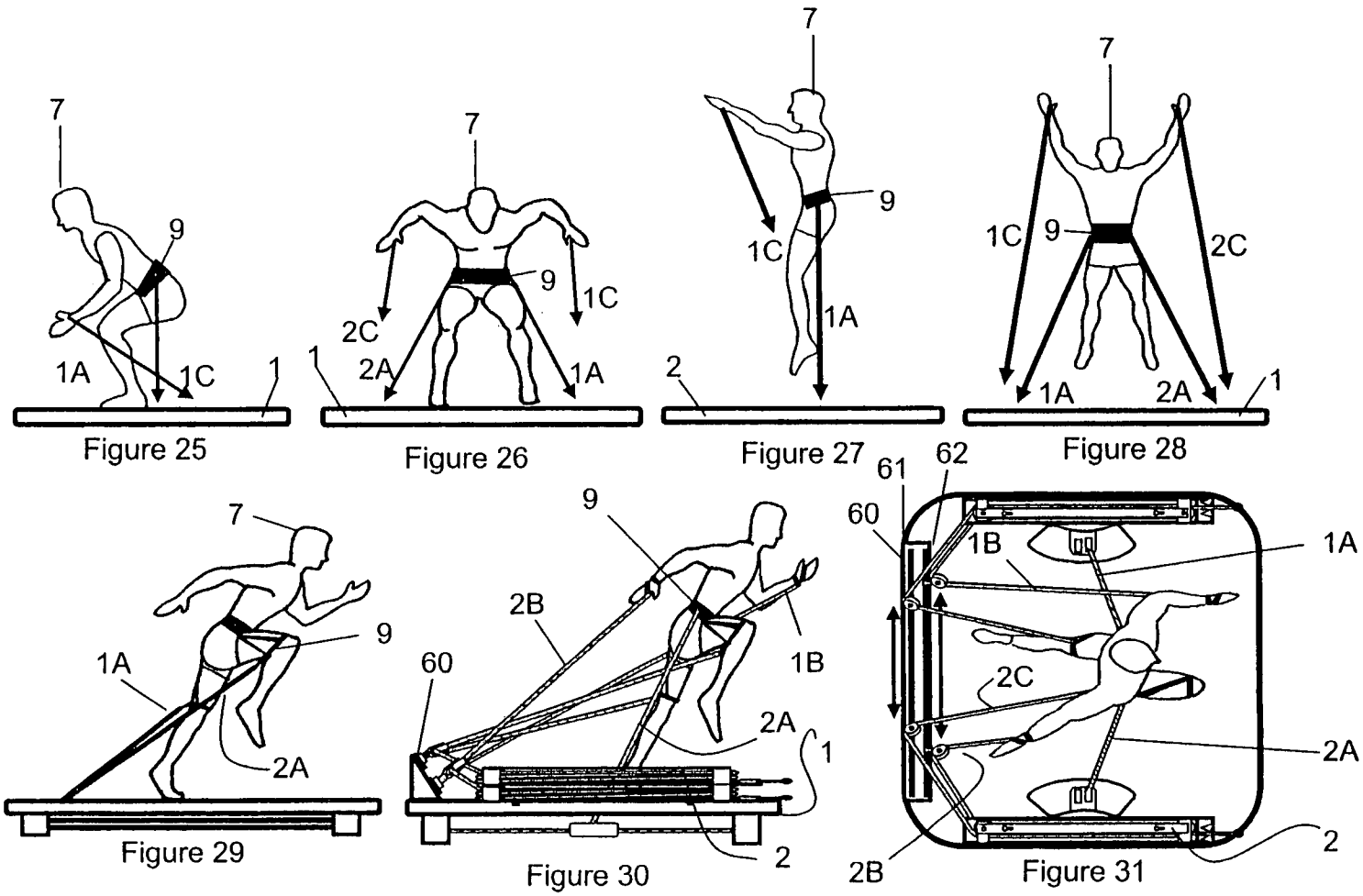
FIGS. 25-29 illustrate side and front views of one embodiment of the lateral training apparatus for providing training vectors to the hands and hips during vertical jump or other exercise training.
FIGS. 30-31 illustrate embodiments of the lateral training apparatus according to the present subject matter for providing at least six training vectors to a trainee.

FIGS. 25-29 illustrate side and front views of one embodiment of the lateral training apparatus for providing training vectors to the hands and hips during vertical jump or other exercise training. With reference to FIGS. 25-29, the lateral training apparatus may be placed flat on the ground or other horizontal surface and provide a jumping, running or exercise platform or base 1 and means for applying the training vectors 1A and 2A to the hips of the trainee 7 and the training vectors 1C and 2C to the hands or wrists of the trainee 7. The training vectors 1A and 2A apply resistance to the legs of the trainee 7 by applying resistance to the harness 9 worn around the waist of the trainee 7 while the training vectors 1C and 2C apply resistance to the arms, shoulders and lower back by applying resistance to a harness (not shown) worn on the hands or wrists of the trainee 7. With reference to FIG. 29, the training vectors 1A and 2A may apply resistance to the thighs of the trainee 7 by applying resistance to the harness 9 worn on the thighs of the trainee 7. As illustrated in FIGS. 25-29, the lateral training apparatus according to this aspect of the present subject matter applies resistance to the legs, back, arms and/or thighs of the athlete simultaneously while performing a vertical jumping motion or running motion. The lateral training apparatus of the present subject matter provides a more efficient jump training and exercise system than the exercise apparatus disclosed in the prior Wehrell patents and further embodiments thereof because it stresses, in addition to the legs, several important muscle groups affecting the performance of a trainee, i.e., the back, shoulders, arms and/or thighs.

FIGS. 30-31 illustrate embodiments of the lateral training apparatus according to the present subject matter for providing at least six training vectors to a athlete. With reference to FIGS. 30-31, the lateral training apparatus 100 comprises the base 1 having an upper surface providing a training surface supporting the trainee 7. Elastic members 1A and 2A are each attached to the harness 9 worn around the waist of the trainee 7. Elastic members 1A and 2A may be directed away from the training surface by tracking means as discussed above. Two sets of stacked mechanical assemblies 2, 3 may be mounted on the upper surface of the base 1 along opposite sides of the base 1 to provide a training area therebetween. The assemblies 2, 3 include elastic members 1B, 2B attached to harnesses that are worn on the hands or wrists of the trainee 7. The assemblies 2, 3 may include elastic members 1C, 2C that are attached to harnesses worn around the thighs and/or knees of the trainee 7. A rail assembly 60 may also be mounted to the upper surface of the base 1 at the front or rear of the training area. In this embodiment for providing resistance to a trainee performing running training, the rail assembly 60 may be mounted at the rear of the training area. The rail assembly 60 comprises a pair of rails 61, 62 adapted to carry one or more pulley assemblies. The rails 61, 62 are slotted so that the pulley assemblies may be positioned along the length thereof. The pulley assemblies may be locked in place by any suitable means such as spring loaded locking mechanisms (not shown). The pulley assemblies may thus provide the points of origin for the training vectors provided by elastic members 1B, 1C, 2B, 2C. Of course, the apparatus 100 may also include a perforated structure 50 or rail assemblies 21-24 as discussed above.

Figure 32:
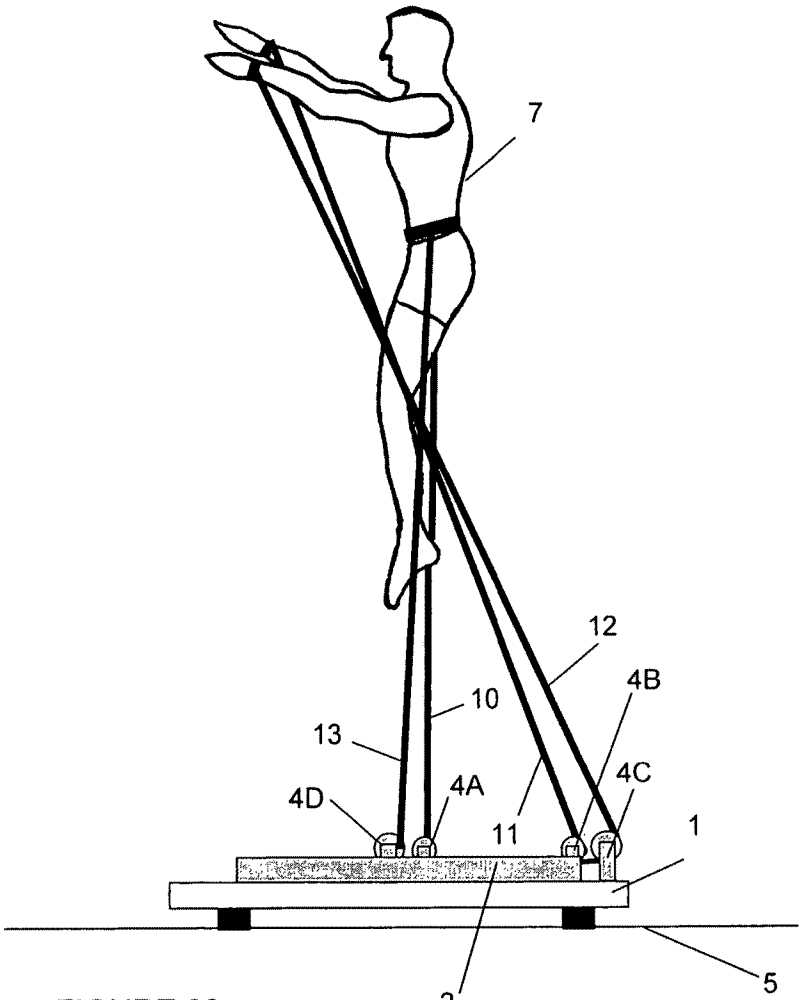
FIG. 32 illustrates a side view of a trainee in the extended position while performing vertical jump training.

FIG. 32 illustrates a side view of a trainee in the extended position while performing vertical jump training. With reference to FIG. 32, additional mechanical assemblies may be stacked on the assemblies 2, 3 to thereby increase the amount of resistance available to the trainee 7. For example, by stacking additional mechanical assemblies, the number of elastic members available for complex athletic motions and exercises may be increased from 4 to 5, 6, 7, 8, 9, 10, 11, 12, and so on.

Figure 1:
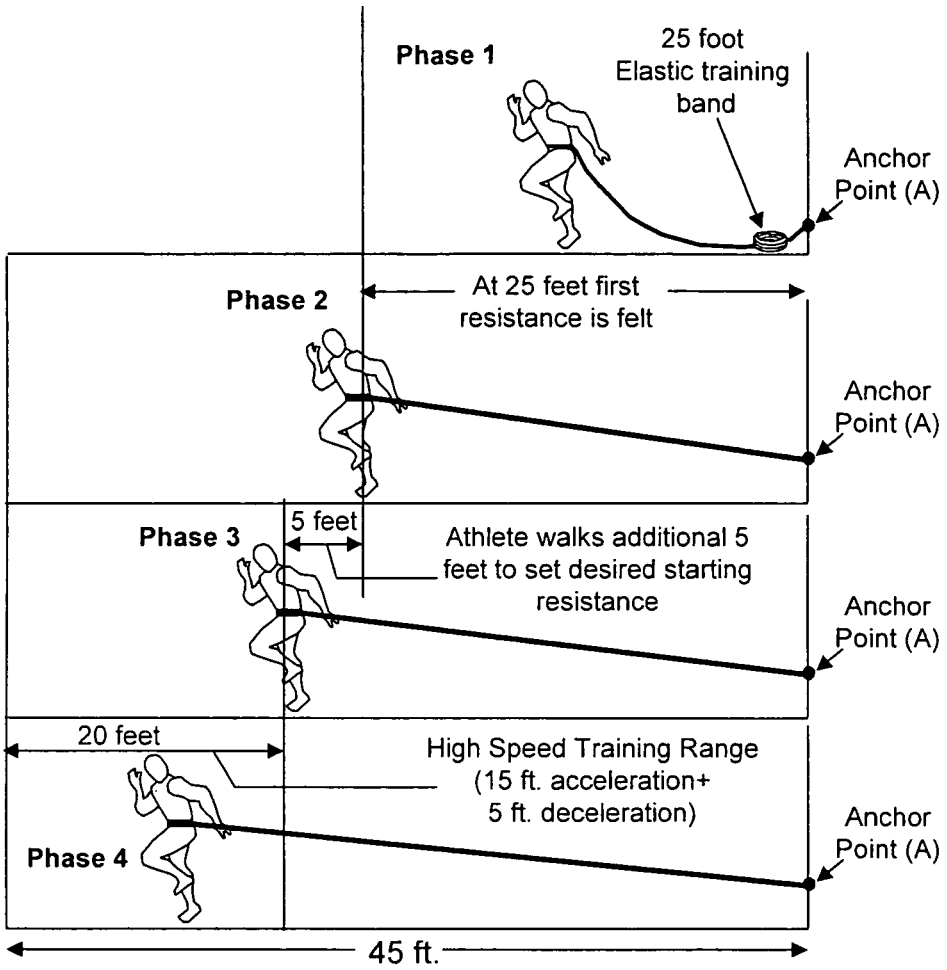
FIG. 1 (Prior Art)
FIG. 1 is a side view of a prior art exercise apparatus with a trainee in standing positions showing a restraining means providing a specified resistance with reference to the trainee.
Figure 2:
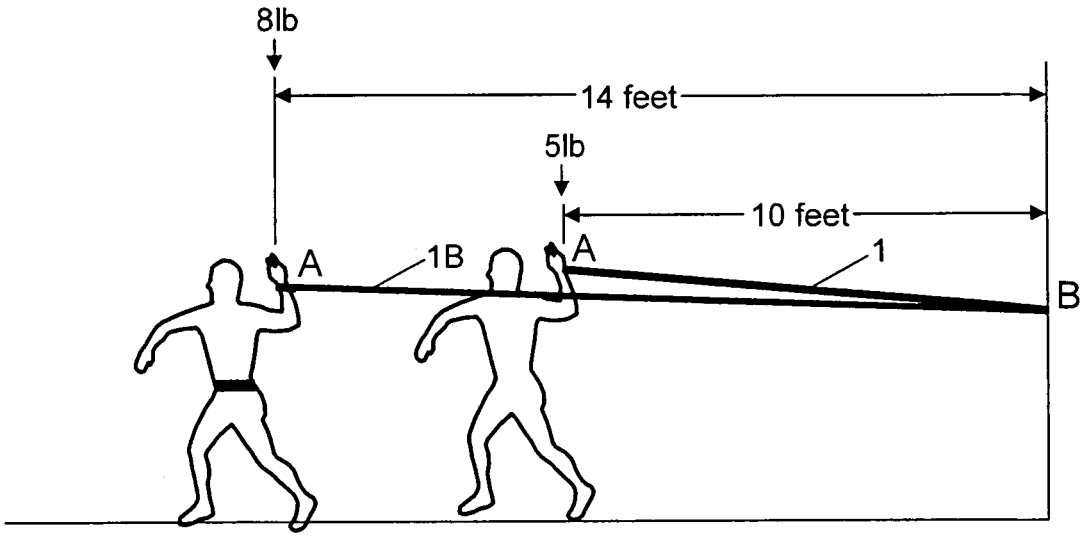
FIG. 2 (Prior Art)
FIG. 2 is a side view of a prior art exercise apparatus with a trainee in a standing position showing a restraining means providing a specified resistance with reference to the trainee.
Figure 3:
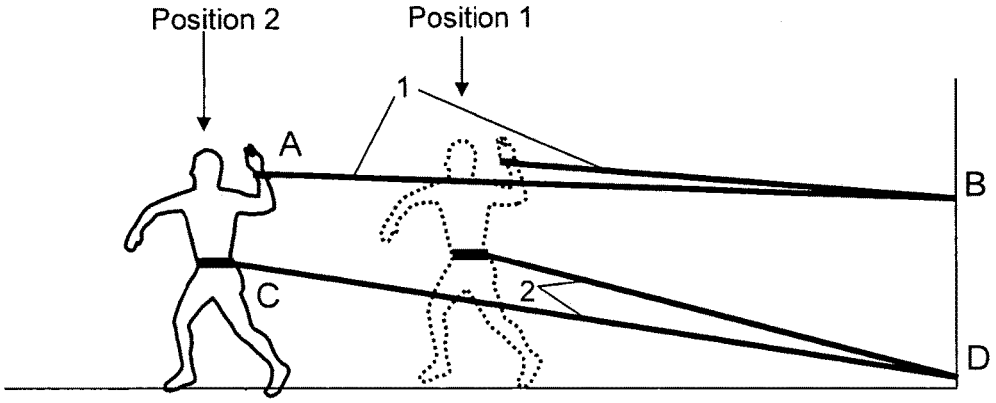
Figure 3 (Prior Art)
FIG. 3 is a side view of a prior art exercise apparatus with a trainee in a standing position showing multiple restraining means providing a specified resistance with reference to the trainee.
Figure 6:
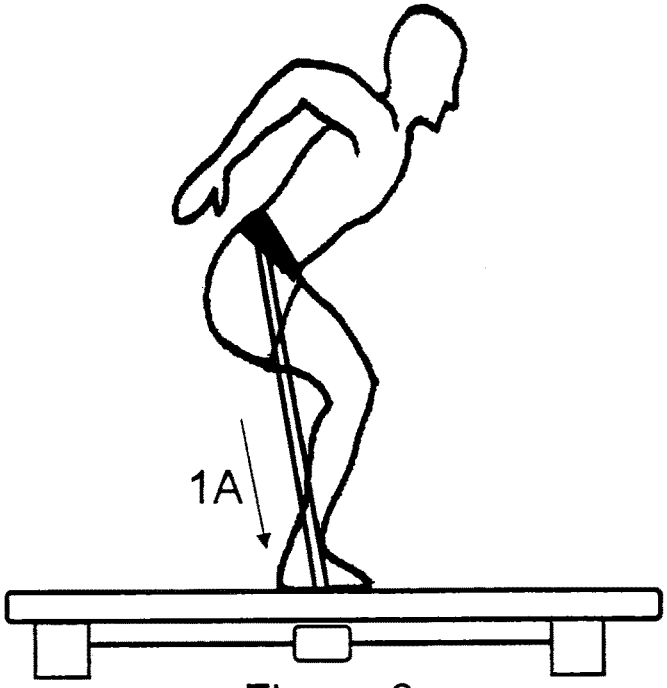
Figure 6 PRIOR ART
FIG. 6 is a side view of the prior art exercise apparatus of FIG. 4 with the trainee preparing to jump, showing the restraining means providing a specified resistance in a retracted position with reference to the trainee.
Figure 7:
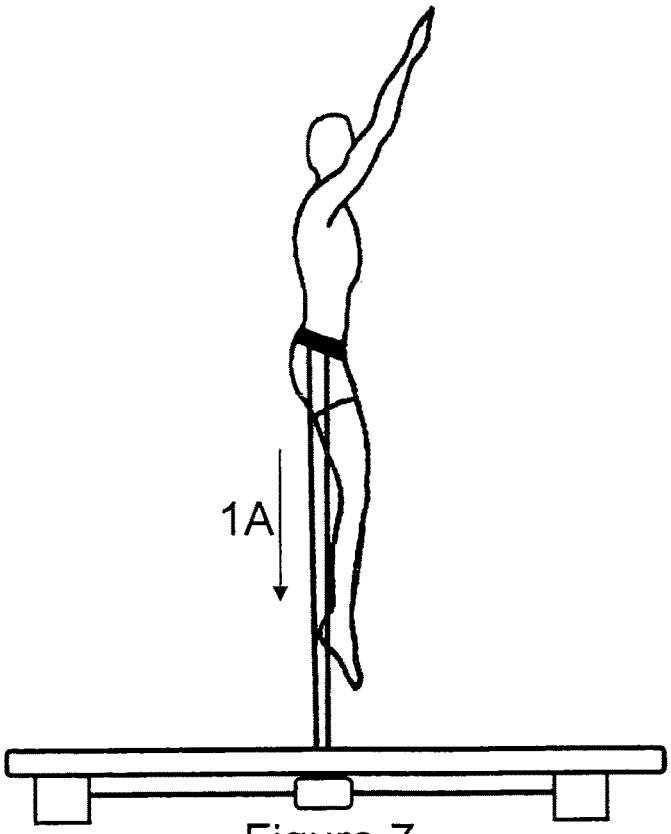
Figure 7 PRIOR ART
FIG. 7 is a side view of the prior art exercise apparatus of FIG. 4 with the trainee at the peak of a jump, showing the restraining means in an extended position.
Figure 33:
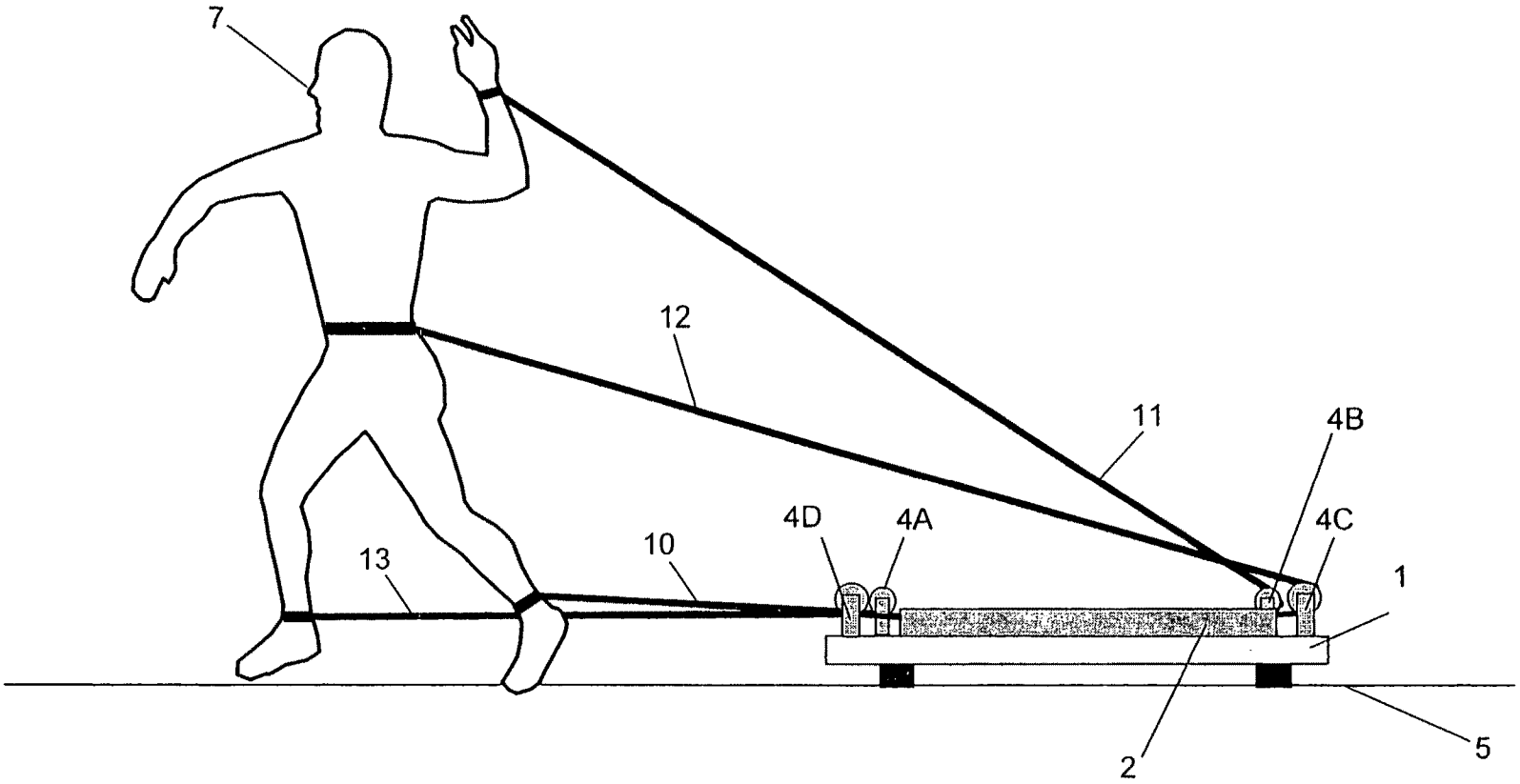
FIG. 33 illustrates a side view of a trainee performing a sports specific movement using an embodiment of the present subject matter.
Figure 34:
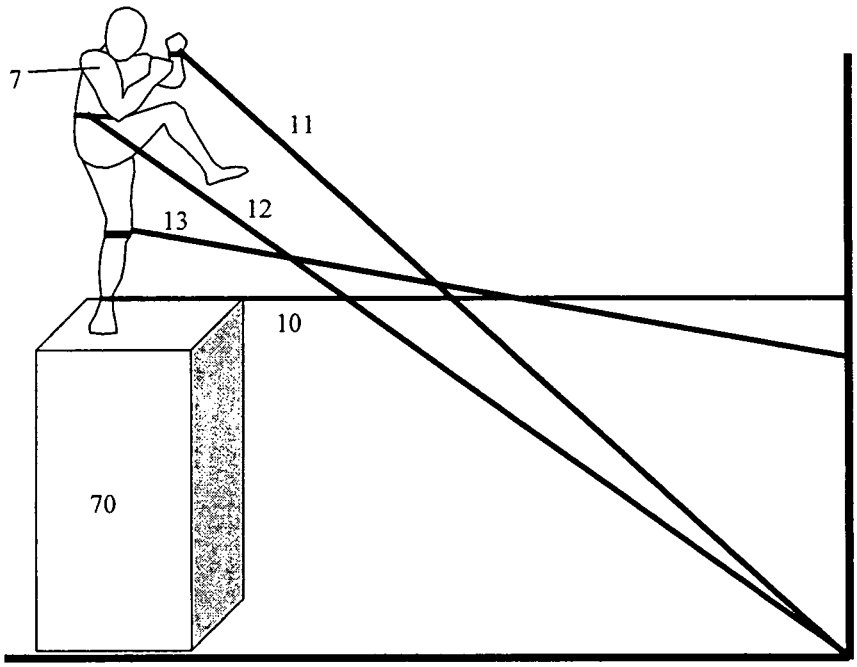
Figure 34 (Prior Art)
FIG. 34 is an illustration of a prior art apparatus for providing training vectors to a trainee.

FIG. 33 illustrates a side view of a trainee performing a sports specific movement using an embodiment of the present subject matter. With reference to FIG. 33, the trainee 7 may perform any number of exercises off the base 1 of the apparatus 100. For example, the pulley assemblies 4A-4D may be positioned on a perforated structure 50 or moved about rail assemblies 21-24, depending upon the desired embodiment, to configure and alter the point of origin of the training vectors provided by the elastic members 10-13 emanating from the mechanical assemblies 2, 3. In the illustrated example, the trainee 7 is performing a throwing motion (e.g., baseball, football, etc.) off the base 1 and may thus removably attach an elastic member 11 to his throwing hand or arm, elastic members 10, 13 to his legs, and an elastic member 12 to his waist. The elastic members 10-13 may be attached to straps, harnesses, gloves and the like worn by the trainee 7 or may be attached to garments, shoes, etc., worn by the trainee. For prior art exercise apparatuses illustrated in FIGS. 2 and 3 to provide similar training vectors, a pedestal 70 would need to be provided to elevate the trainee while attaching the elastic members 25 feet away. This depiction is illustrated in FIG. 34.

Figure 35:
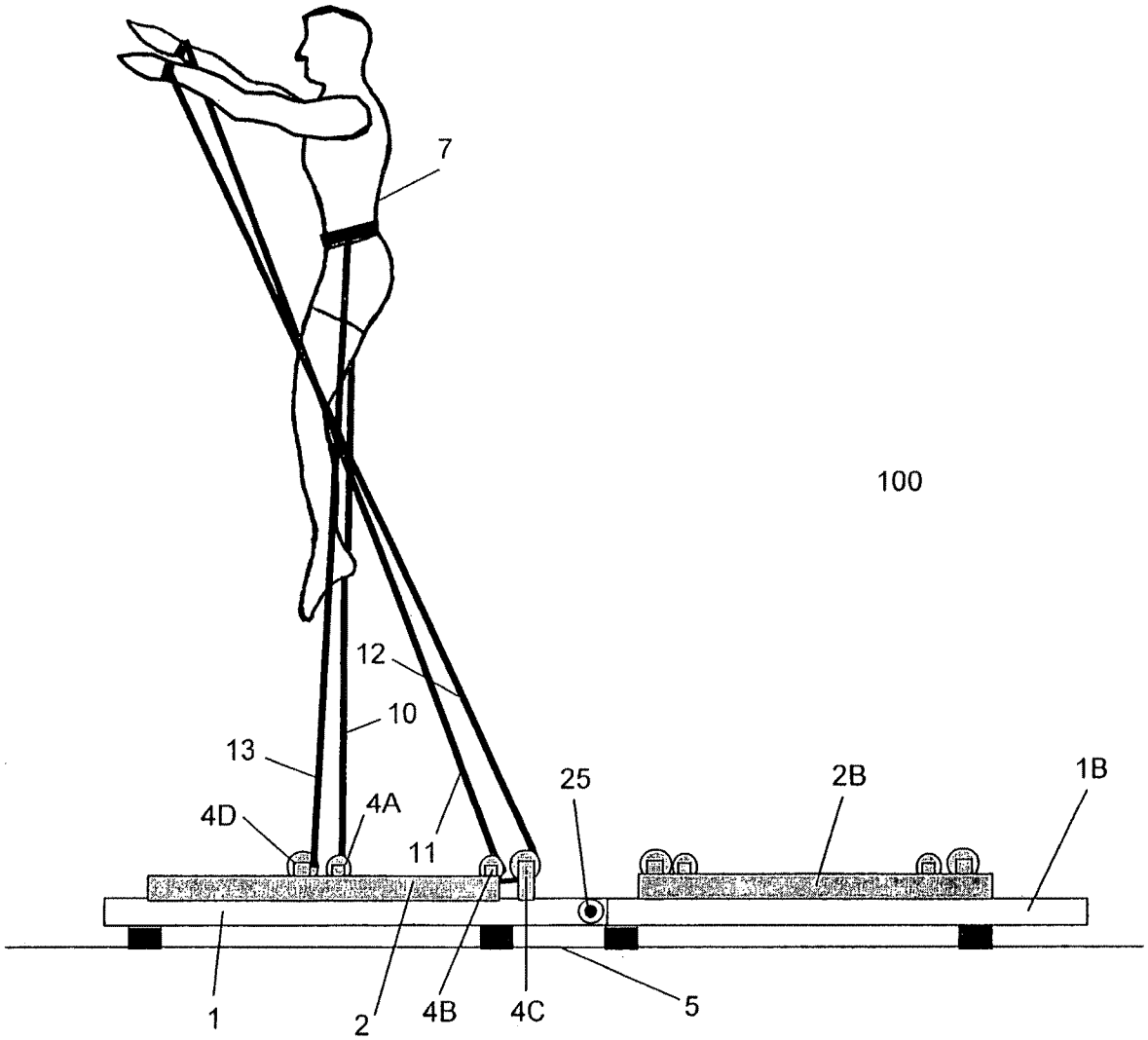
FIGS. 35 and 36 are a side views of another embodiment of the present subject matter with a trainee in the extended position while performing vertical jump training and a trainee performing a throwing motion, respectively.
Figure 36:
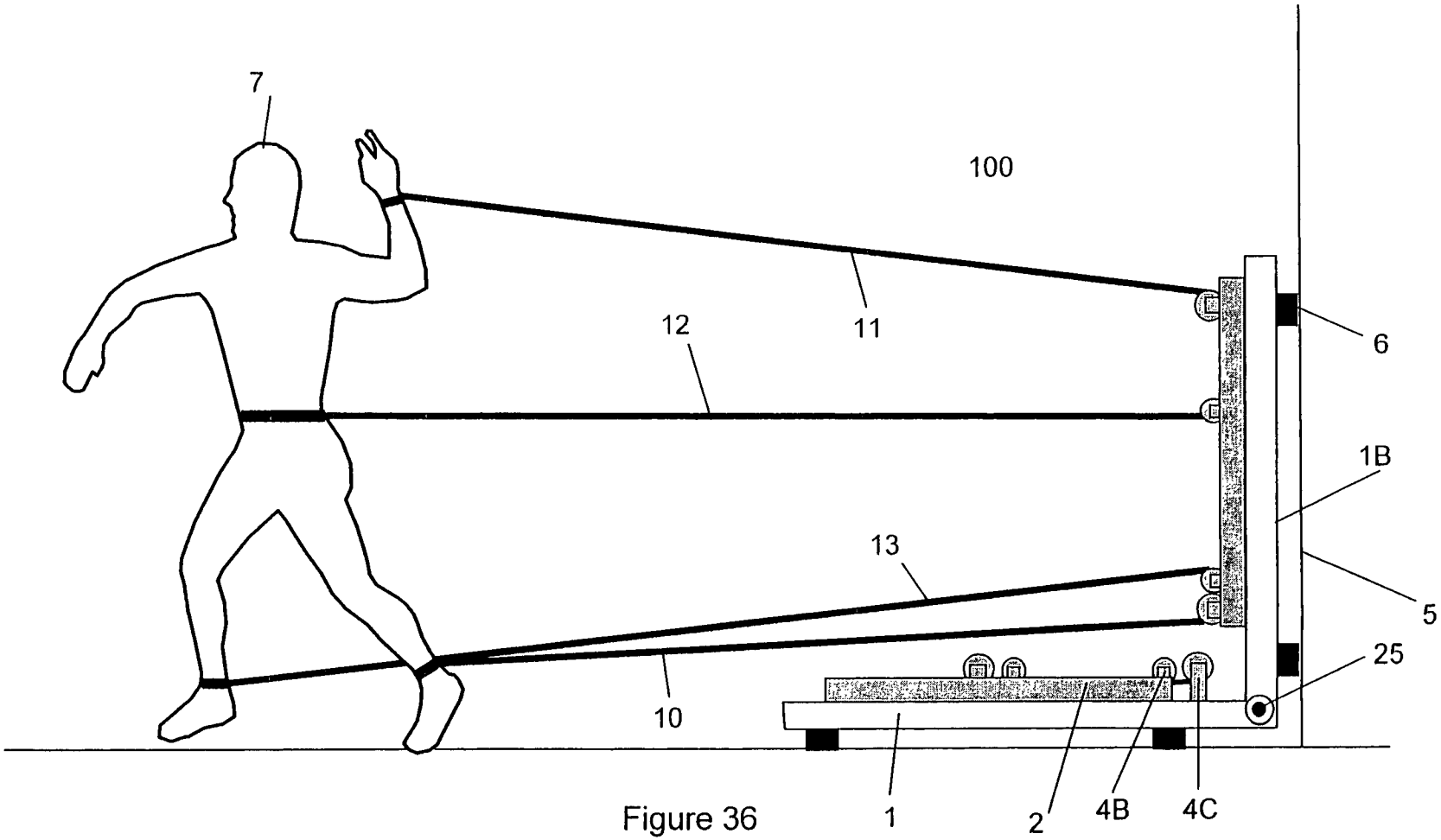

FIGS. 35 and 36 are a side views of another embodiment of the present subject matter with a trainee in the extended position while performing vertical jump training and a trainee performing a throwing motion, respectively. With reference to FIG. 35, the lateral training apparatus 100 may include a planar base extension 1B with additional mechanical assemblies 2B, 3B attached thereon. The base extension 1B may include any one or all of the features and components present on the base 1. The base extension 1B may be operably attached to the base 1 by one or more hinges 25 extending along adjacent sides thereof. The hinge 25 may thus allow rotation of either the base 1 or the base extension 1B and subsequent attachment of the rotated portion via exemplary fasteners to a vertical plane 5 as shown in FIG. 36. Any number of exercises may be performed on the training surface formed by the base 1 and/or base extension 1B, as appropriate. Of course, any number of exercises may be performed off the training surface formed by the base 1 and/or base extension 1B. The embodiment illustrated in FIG. 36 may allow any number of elastic members to provide resistance in vertical and horizontal directions and provide training vectors having movable points of origin vertically and horizontally. In another embodiment, the rotated portion (either the base 1 or base extension 1B) may be locked in position using a locking mechanism or pin, the rotated portion being free-standing and unattached to a planar surface 5.

Figure 37:
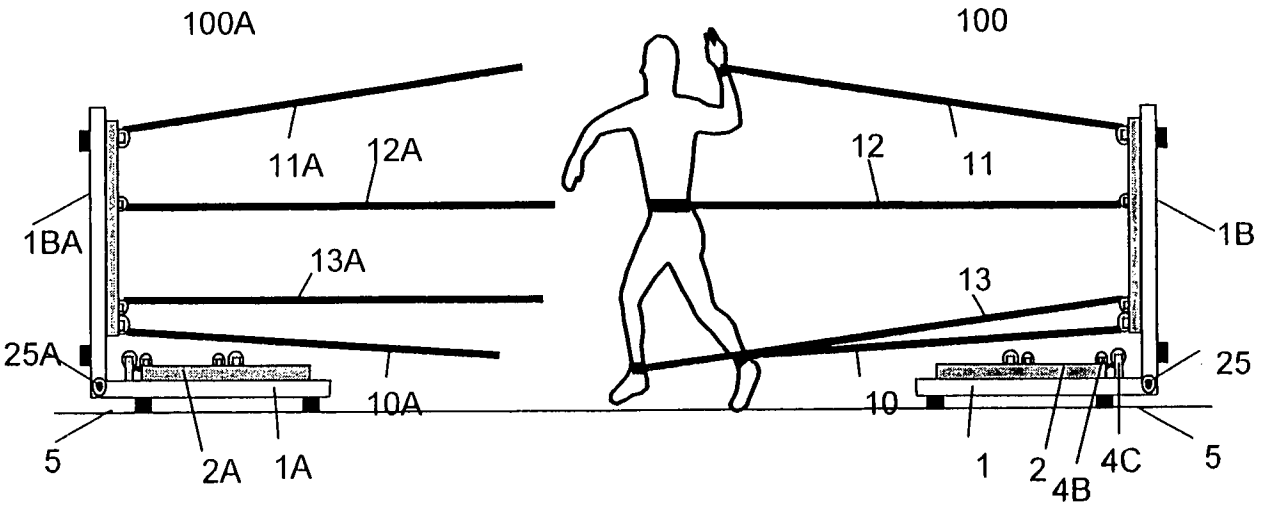
FIG. 37 is a lateral training apparatus according to another embodiment of the present subject matter.

FIG. 37 is yet another illustration of a lateral training apparatus according to an embodiment of the present subject matter. With reference to FIG. 37, an additional lateral training apparatus 100A may be provided in conjunction with the lateral training apparatus 100 of FIG. 36. For example, the lateral training apparatus 100A may also include a planar base extension 1BA with additional mechanical assemblies 2A, 3A attached thereon. The lateral training apparatus 100A may include any one or all of the features and components present on the lateral training apparatus 100. Any number of exercises may be performed on the training surface formed by the bases 1, 1A and/or base extensions 1B, 1BA, as appropriate. Of course, any number of exercises may be performed off the training surface by the bases 1, 1A and/or base extensions 1B, 1BA. The embodiment illustrated in FIG. 37 may allow any number of elastic members to provide resistance in vertical and horizontal directions from multiple and/or opposing directions and provide training vectors having movable points of origin vertically and horizontally in multiple and/or opposing directions.

Figure 38:
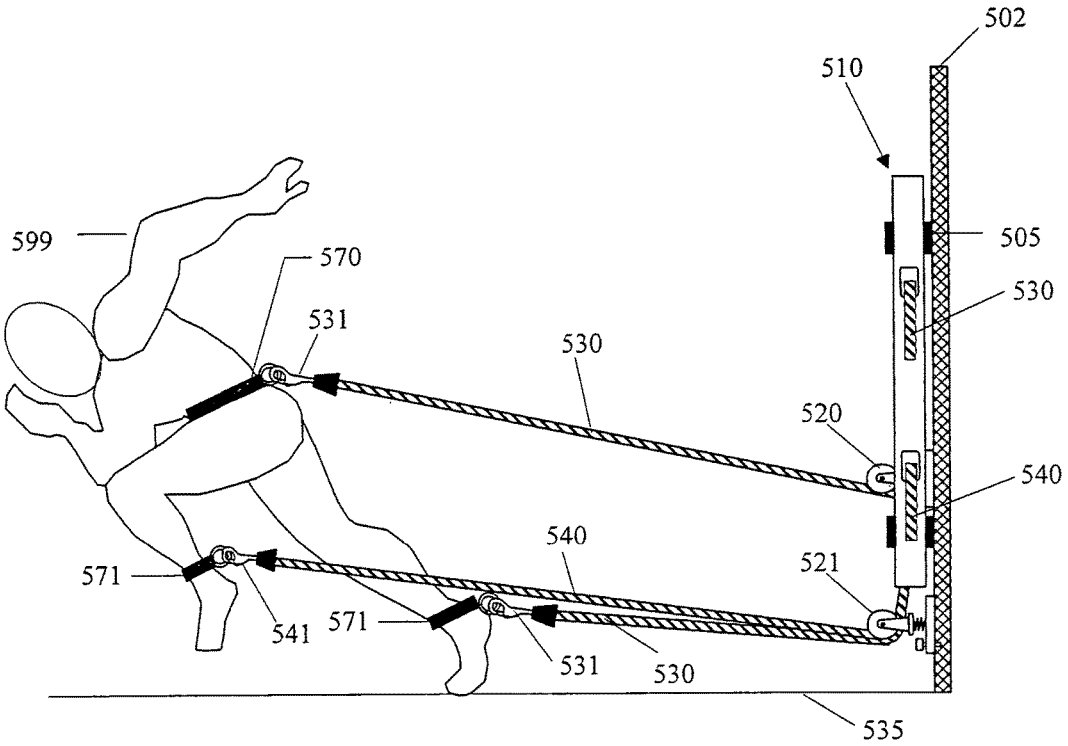
FIG. 38 is a side view of a lateral training apparatus according to an embodiment of the present subject matter with a trainee performing a sprint exercise running away from the apparatus.

FIG. 38 is a side view of a lateral training apparatus according to an embodiment of the present subject matter with a trainee performing a sprint exercise running away from the apparatus. With reference to FIG. 38, an exemplary lateral training apparatus 500 may comprise one or more mechanical assemblies or resistance modules 510 mounted to a vertical support surface 502. Exemplary resistance modules 510 may include elastic members or cords 530, 540 and utilize detachable pulley assemblies 520, 521 to direct the elastic members to trainee 599. In another embodiment, a mechanical assembly may comprise one or pulley assemblies suitably mounted to the base of the apparatus. In yet another embodiment, suitable mechanical assemblies may be attached to the base for directing one or more resistance members from the base and for providing a training vector opposing the motion of the trainee in a predetermined range of motion whereby the assembly provides a force that is relatively constant or varying over the predetermined range. In this embodiment, the mechanical assembly may be an electronic spool, hydraulic assembly, pneumatic assembly, spring-driven assembly, and/or motor-driven assembly. Suitable connector mechanisms 531, 541 may be utilized in conjunction with a waist harness 570, ankle straps 571, or other garments or harnesses to thereby connect respective elastic members to the trainee 599 for low or high speed training. Exemplary harnesses, straps and the like, may be made of any suitable material and should be adjustable to fit snugly on the trainee and padded to prevent chaffing.

The trainee 599 may be moving towards or away from apparatus 500. In embodiments of the present subject matter where the apparatus 500 is affixed to a vertical surface, the exercise area may be formed by the ground 535. As few as one or as many as eight or more elastic members may be utilized by a trainee performing complex athletic movements. Generally, the number of elastic members provided by embodiments of the present subject matter is dependent upon the number of resistance modules 510 with two cords or modules 215 with a single cord as shown in FIG. 17. Elastic members or cord length may generally be dependent upon the type of material used, the internal pulley configuration, and size of the resistance module 215, 510. Additional assemblies or modules may be stacked on existing modules 215, 510 to allow for simultaneous resistance application to five unique points.

Figure 39:
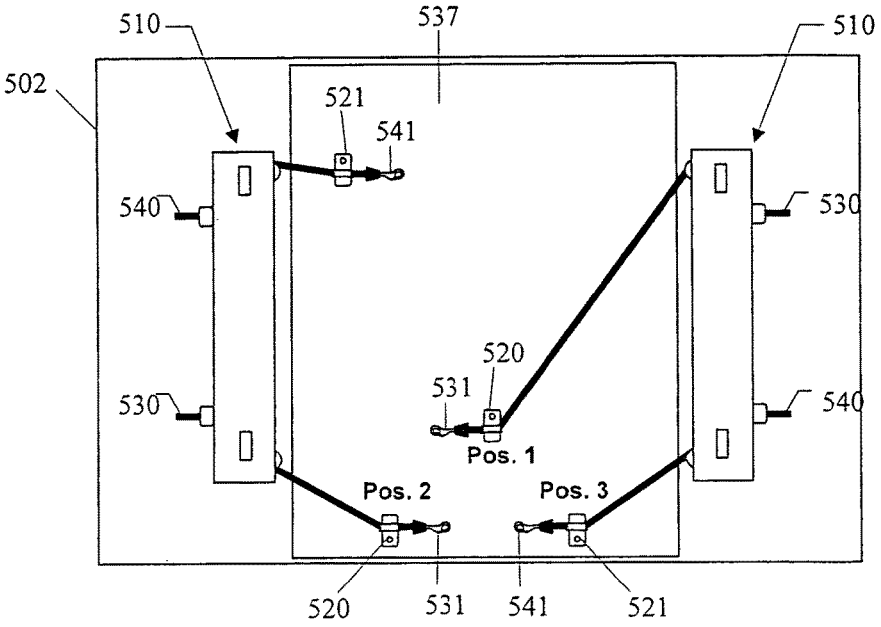
FIG. 39 is a front view of the lateral training apparatus of FIG. 38.

FIG. 39 is a front view of the lateral training apparatus of FIG. 38. With reference to FIG. 39, two assemblies 510 may be fastened to a vertical plane 502, such as a chain link fence or wall, via suitable fasteners 505. Moveable pulley assemblies 520, 521 may be positioned at multiple locations within an area 537 using suitable locking mechanisms. The assemblies 520, 521 are shown in FIGS. 38 and 39 in Positions 1, 2 and 3 to provide exemplary force vectors for the sprint exercise illustrated in FIG. 38.

Figure 41:
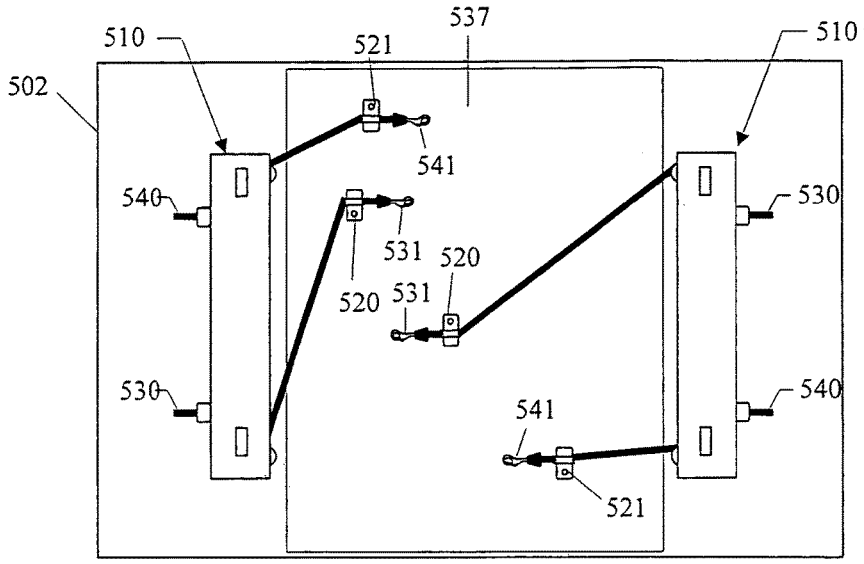
FIG. 41 is a front view of the lateral training apparatus of FIG. 40.
Figure 40:
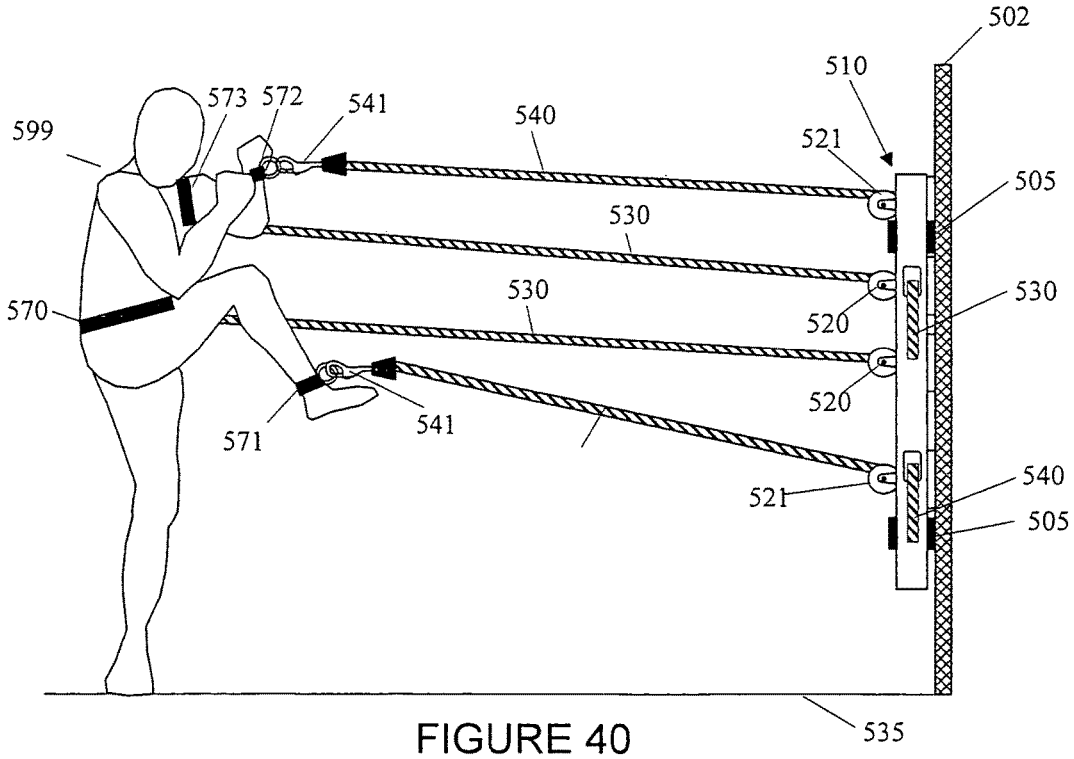
FIG. 40 is a side view of the lateral training apparatus of FIG. 38 configured to assist a trainee in performing a throwing exercise for a left handed pitcher.

FIG. 40 is a side view of the lateral training apparatus of FIG. 38 configured to assist a trainee in performing a throwing exercise for a left handed pitcher. FIG. 41 is a front view of the lateral training apparatus of FIG. 40. With reference to FIGS. 40 and 41, moveable pulley assemblies 520, 521 may be positioned at appropriate positions on the surface area 537 to conduct an advance throwing exercise for a left handed pitcher. Of course, the positions of the pulley assemblies 520, 521 may be re-positioned for a right handed pitcher or may be repositioned for another throwing exercise, such as, but not limited to, a right or left handed football passing exercise. A shoulder harness 573, wrist harness 572, waist harness 570 and ankle harness 571 may allow attachment of four elastic members to resist the trainee's pitching motion. Of course, the positions of the pulley assemblies 520, 521 may be placed at any position/elevation to provide the proper training vectors for running, throwing, passing, jumping, kicking, boxing, sprinting, pitching, swinging, and other sports-specific movements and exercises.

Figure 42:
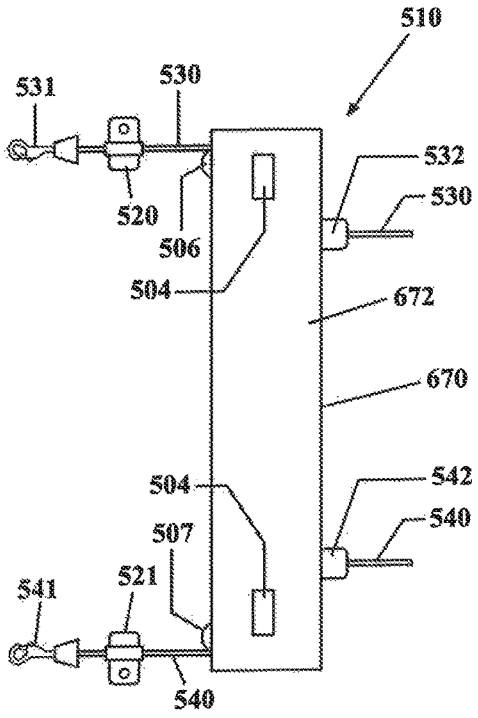
FIG. 42 is a top plan view of an exemplary mechanical assembly such as a resistance module according to an embodiment of the present subject matter.
Figure 43:
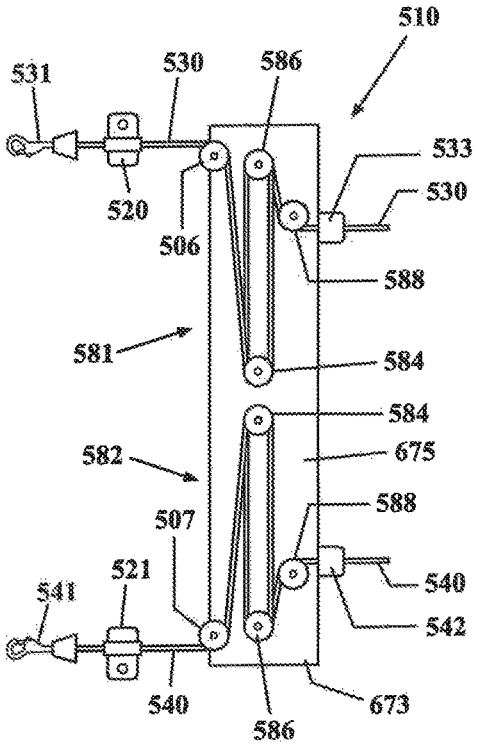
FIG. 43 is an illustration of an internal configuration of the resistance module of FIG. 42.
Figure 44:
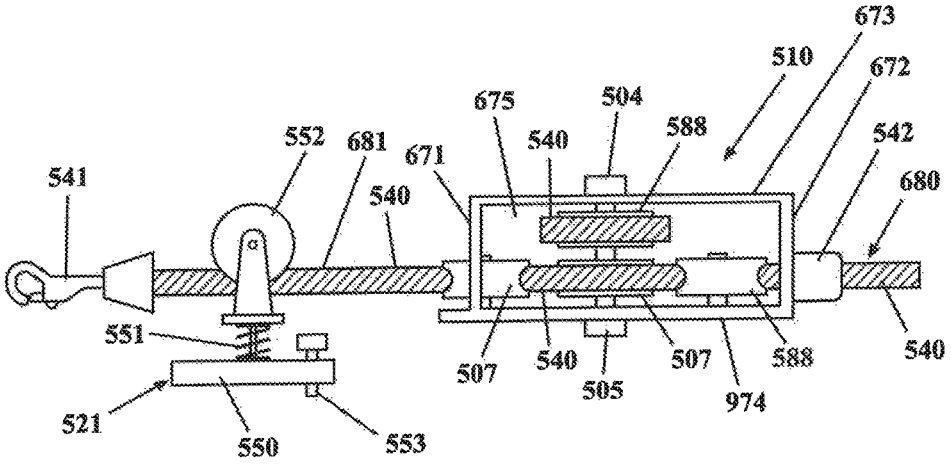
FIG. 44 is a side view of the resistance module of FIG. 42.

FIG. 42 is a top plan view of an exemplary mechanical assembly such as a resistance module 510 according to an embodiment of the present subject matter. The module has a housing having walls 671, 672, 673, and 674 defining an interior 675. With reference to FIG. 42, the module 510 may comprise two elastic members or resistance cords 530, 540. Suitable attachment means 531, 541 may be utilized to attach the elastic members 530, 540, respectively, to the trainee. One end of the members 530, 540 exiting the module 510 may be fed through suitable anchor or locking mechanisms 532, 542, respectively. Exemplary locking mechanisms may be, but are not limited to, cam cleats allowing the respective members to be extracted and retracted easily with an automatic locking ability after retraction or extraction. Extracting the members 530, 540 from the locking mechanisms 532, 542, respectively, will decrease the effective length of the member internal to the module 510 and thus increase the applied resistance at the respective attachment means 531, 541. Allowing members 530, 540 to retract into the module 510 by releasing the locking mechanisms 532, 542 will increase the effective length of the respective member internal the module 510 thus decreasing the applied resistance at the respective attachment means 531, 541. Pulley mechanisms 506, 507 as illustrated in FIGS. 42-44 serve as exit guides and may be utilized to route respective elastic members 530, 540 through and out of the module 510 to a trainee. Distal ends of the members 530, 540 utilized by the trainee for various exercises and movements may be routed through detachable, slidable and moveable swivel pulley assemblies 520, 521 which may also serve as exit guiles. The pulley assemblies 520, 521 provide a suitable attachment means allowing the respective pulley assemblies to be attached to chain link fences, vertical or horizontal planes or suitably designed attachment areas 537. The pulley assemblies also allow the user to select the vector origin independent of the location of module 510. Each module 510 may also comprise an attachment means 504 on top of the module 510 to allow attachment and stacking of multiple modules 510 on top of one another via attachment means 505 fixed to the underside of the module 510. Suitable means 504, 505 such as, but not limited to, keyways, pegs, Velcro, etc., may be designed to interlock to form an exemplary stacked assembly with plural modules 510 thereby providing 4, 6, 8 or more elastic members or resistance cords for exercise.

FIG. 43 is an illustration of an internal configuration of the resistance module of FIG. 42. With reference to FIG. 43, elastic members 530, 540 may be routed through respective single and stacked pulley assemblies 506, 507. A first end portion of the elastic member is mounted to the anchor or locking means. A second end portion 681 extends externally from the guide 507 and an intermediate portion 682 is routed through the pulleys. The length of the members 530, 540 contained in the module 510 may be dependent upon the distance between and the number of stacked pulley assemblies 506, 507.

FIG. 44 is a side view of the resistance module of FIG. 42. With reference to FIG. 44, the entrance and exit guide or pulleys 507 as well as stacked pulley mechanisms 507 internal to the module 510 may be seen with the member 540 routed therethrough. An exemplary pulley assembly 521 may include one or more pulleys 552, a rotational and vertical tilt mechanism 551, a base 550 and a suitable attachment means 553, such as a spring loaded pin, for attachment to chain link fences and other vertical or horizontal surfaces, or an appropriately designed area 537. In one embodiment, the locking mechanism 542 may be fixed to the module 510 to allow easy member 540 length/tension adjustments internal to the module 510 that translates to the trainee through suitable connector means 541.

Figure 45:
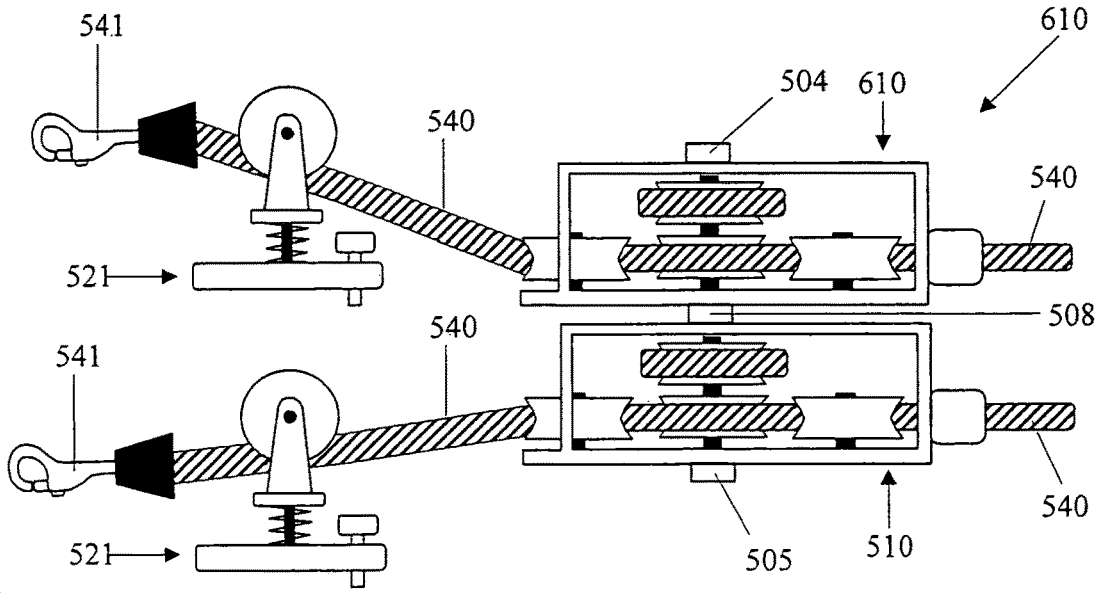
FIG. 45 is a side view of two interlocked mechanical assemblies creating a stacked assembly configuration according to one embodiment of the present subject matter.
Figure 46:
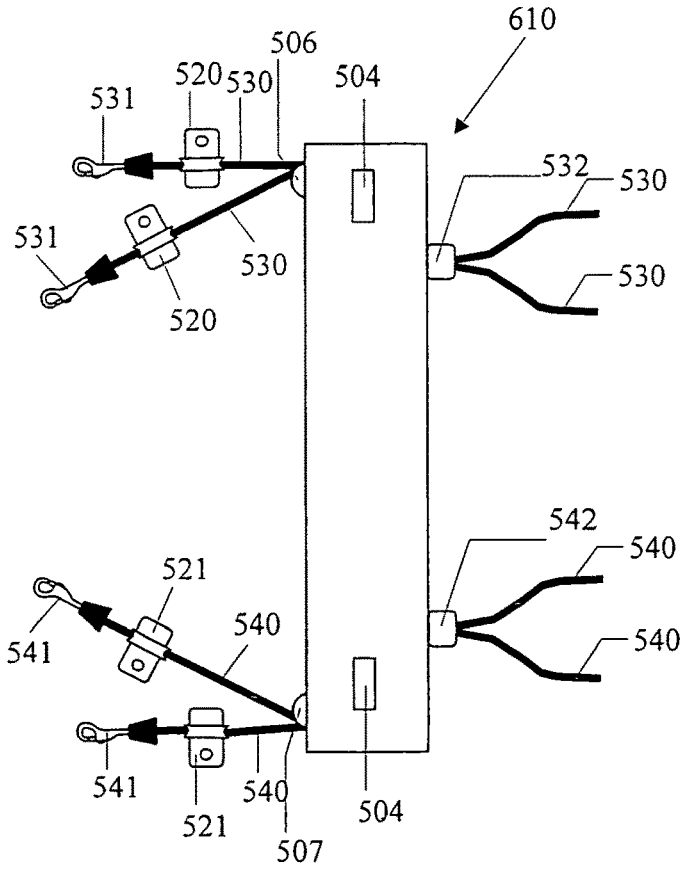
FIG. 46 is a top plan view of the configuration of FIG. 45.

FIG. 45 is a side view of two interlocked mechanical assemblies creating a stacked assembly configuration according to one embodiment of the present subject matter. FIG. 46 is a top plan view of the configuration of FIG. 45. With reference to FIGS. 45 and 46, one or more mechanical assemblies or modules 510 may be interlocked and stacked on one another to create a stacked assembly configuration 610. The stacked configuration 610 provides four resistance members exiting from the left side thereof for use by one or more trainees. The interlocking is achieved utilizing the design of suitable attachment means 504, 505 mating together to create a merged portion 508.

Figure 47:
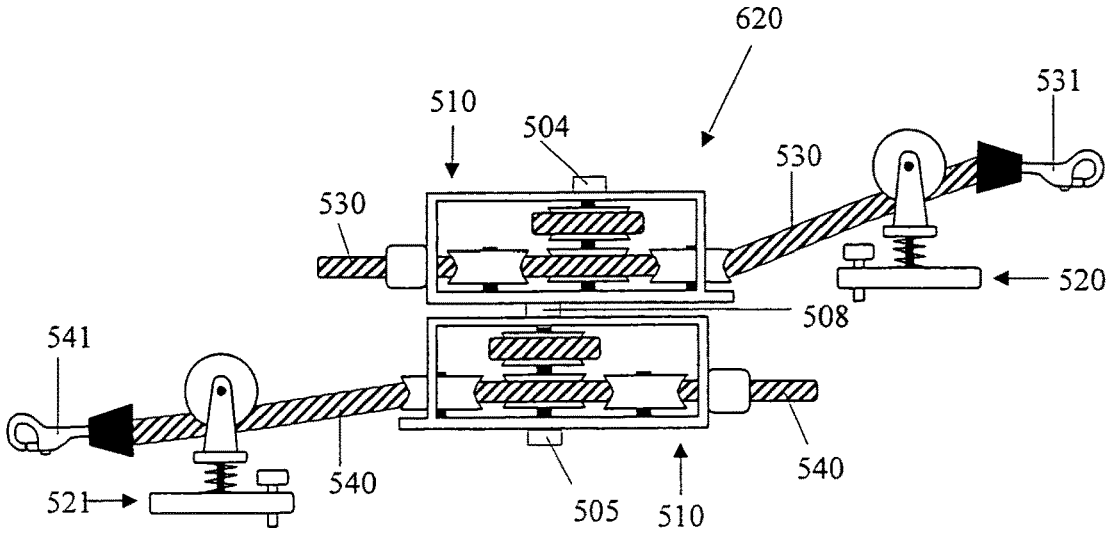
FIG. 47 is a side view of two interlocked mechanical assemblies creating another stacked assembly configuration according to one embodiment of the present subject matter.
Figure 48:
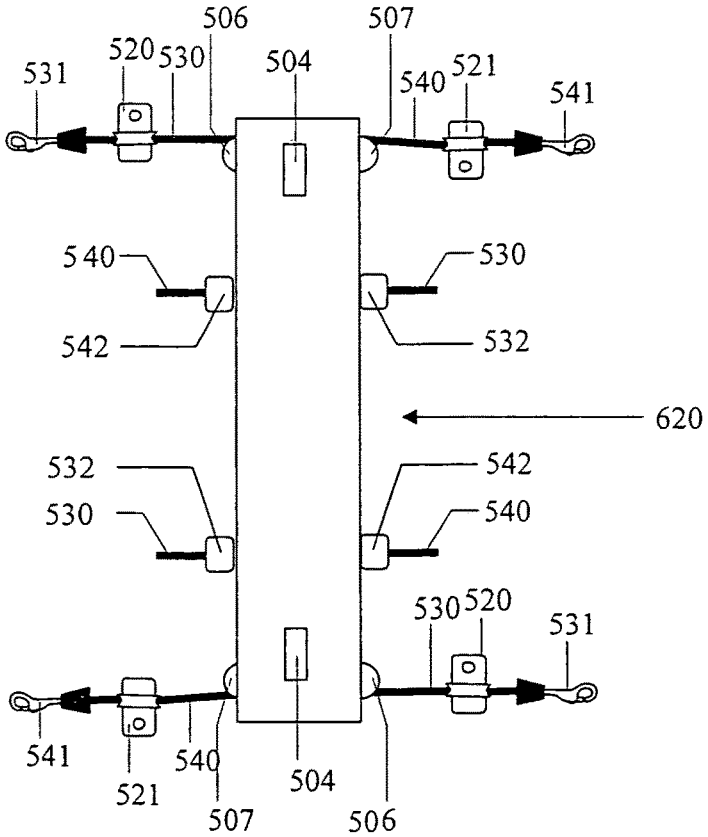
FIG. 48 is a top plan view of the configuration of FIG. 47.

FIG. 47 is a side view of two interlocked mechanical assemblies creating another stacked assembly configuration according to one embodiment of the present subject matter. FIG. 48 is a top plan view of the configuration of FIG. 47. With reference to FIGS. 47 and 48, one or more mechanical assemblies or modules 510 may be interlocked and stacked on one another to create an alternative stacked assembly configuration 620. The stacked configuration 620 provides two resistance members exiting from the left side thereof for use by one or more trainees and two resistance members exiting from the right side thereof for use by one or more trainee.

Figure 49:
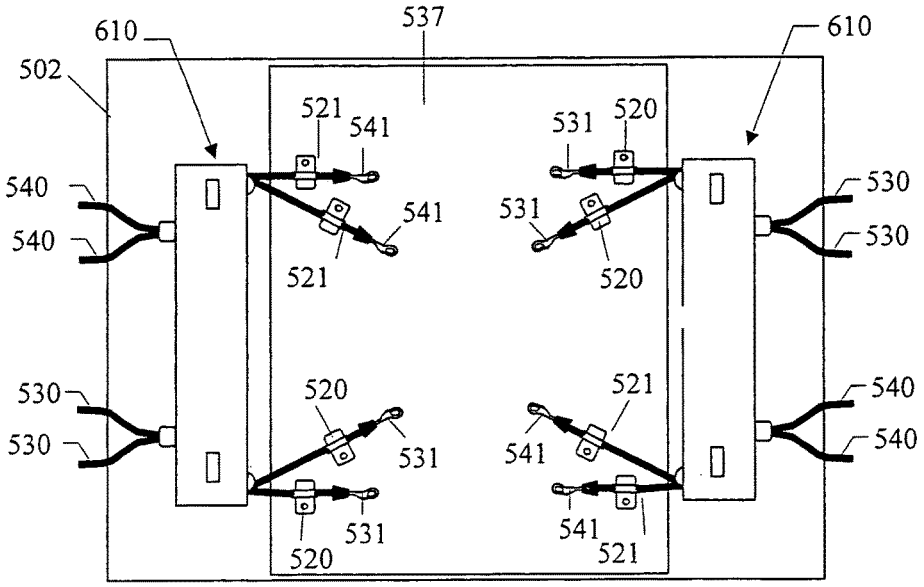
FIG. 49 is a front view of a lateral training apparatus according to one embodiment of the present subject matter.
Figure 50:
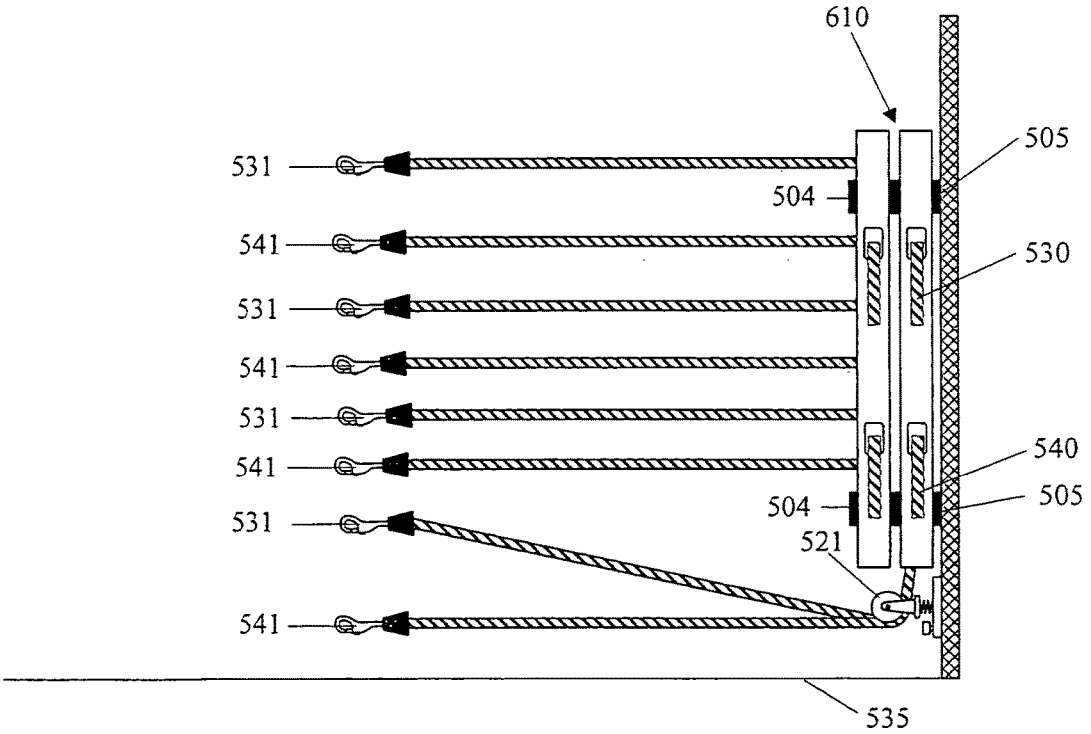
FIG. 50 is a side view of the lateral training apparatus of FIG. 49.

FIG. 49 is a front view of a lateral training apparatus according to one embodiment of the present subject matter. FIG. 50 is a side view of the lateral training apparatus of FIG. 49. With reference to FIGS. 49 and 50, the lateral training apparatus may provide a stacked configuration of assemblies 610 to provide eight resistance members to one or more trainees. Pulley assemblies 520, 521 allow force vector origins relative to the trainee(s) to be fixed anywhere in the area 537.

Figure 51:
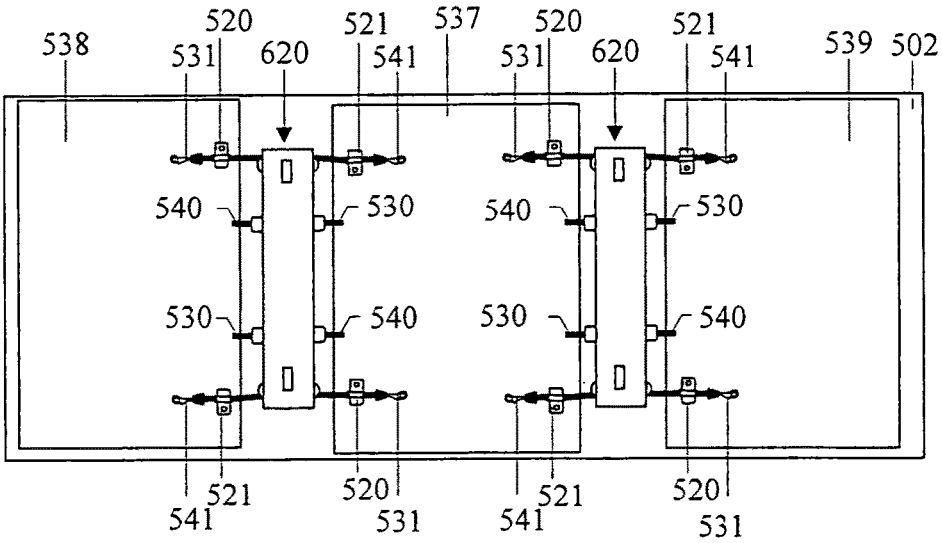
FIG. 51 is a front view of a lateral training apparatus according to another embodiment of the present subject matter.

FIG. 51 is a front view of a lateral training apparatus according to another embodiment of the present subject matter. With reference to FIG. 51, the lateral training apparatus may provide a stacked configuration of assemblies 610 to provide eight resistance members to one or more trainees. Pulley assemblies 520, 521 allow force vector origins relative to the trainee(s) to be fixed anywhere in the respective areas 537, 538, 539 to provide additional space for multiple trainees to train side by side.

Figure 52:
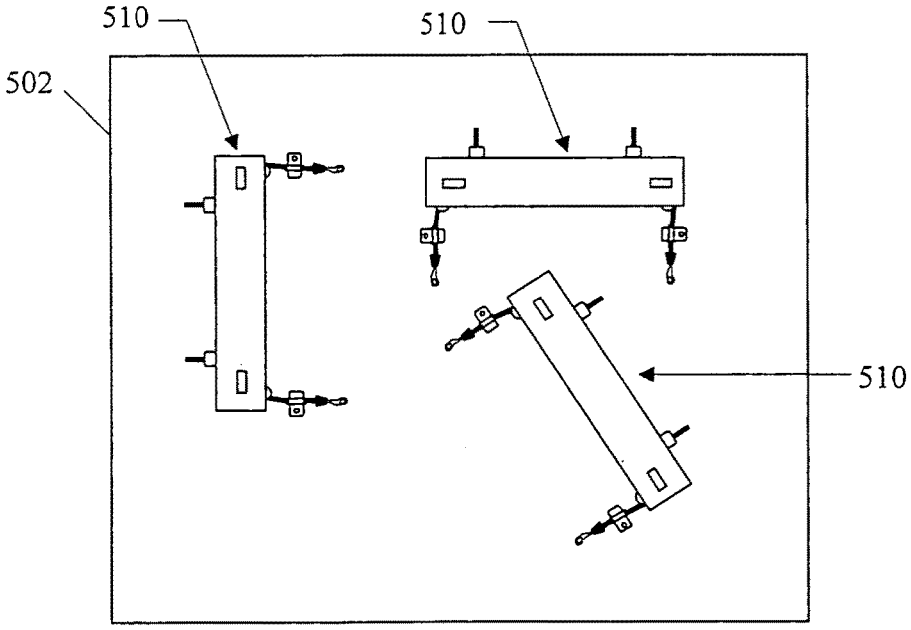
FIG. 52 is a front view of a lateral training apparatus according to an additional embodiment of the present subject matter.

FIG. 52 is a front view of a lateral training apparatus according to an additional embodiment of the present subject matter. With reference to FIG. 52, exemplary modules 510 may be affixed to any vertical support surface 502 in any orientation (vertical, horizontal or at an angle). In embodiments of the present subject matter having multiple tracking assemblies rather than a module as depicted, the tracking assemblies may also be affixed to any vertical support surface in any orientation.

Figure 53:
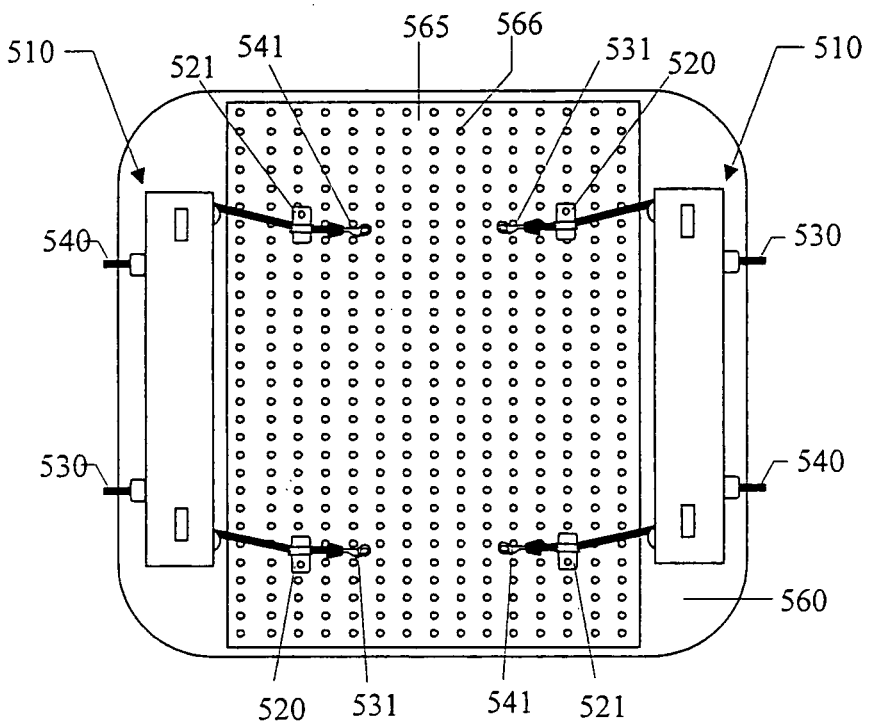
FIG. 53 is a front view of a lateral training apparatus according to an embodiment of the present subject matter.
Figure 54:
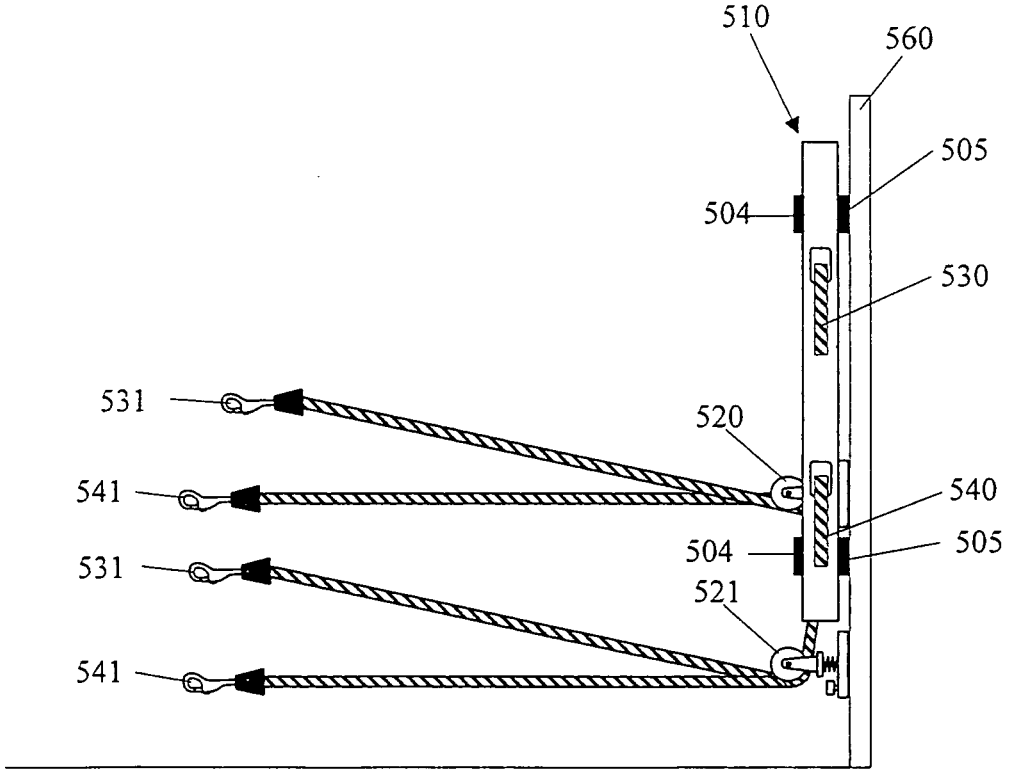
FIG. 54 is a side view of the lateral training apparatus of FIG. 53.

FIG. 53 is a front view of a lateral training apparatus according to an embodiment of the present subject matter. FIG. 54 is a side view of the lateral training apparatus of FIG. 53. With reference to FIGS. 53 and 54, one or more assemblies or modules 510 may be affixed to a fixed vertical structure 560. A flat structure 565 having multiple receptacles or perforations 566 may receive the pulley assemblies 520, 521 via the attachment means 553. This exemplary configuration may be utilized to configure the lateral training apparatus on a wall where there exists no inherent means to receive and secure pulley assemblies 520, 521.

Figure 55:
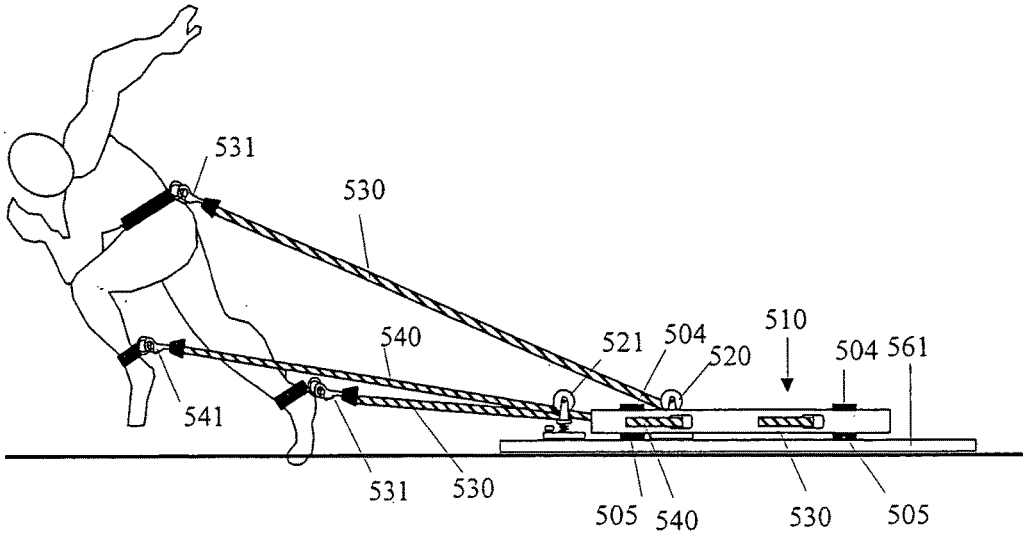
FIG. 55 is a side view of the lateral training apparatus of FIG. 52 in a horizontal configuration.

FIG. 55 is a side view of the lateral training apparatus of FIG. 52 in a horizontal configuration. With reference to FIG. 55, a substantially horizontal base 561 may be substituted for the vertical support surface 560 thereby eliminating the need for a vertical support. Any number of multi-cord training exercises may be performed on or off the base 561, such as the sprinting exercise depicted in FIG. 55.

Figure 56:
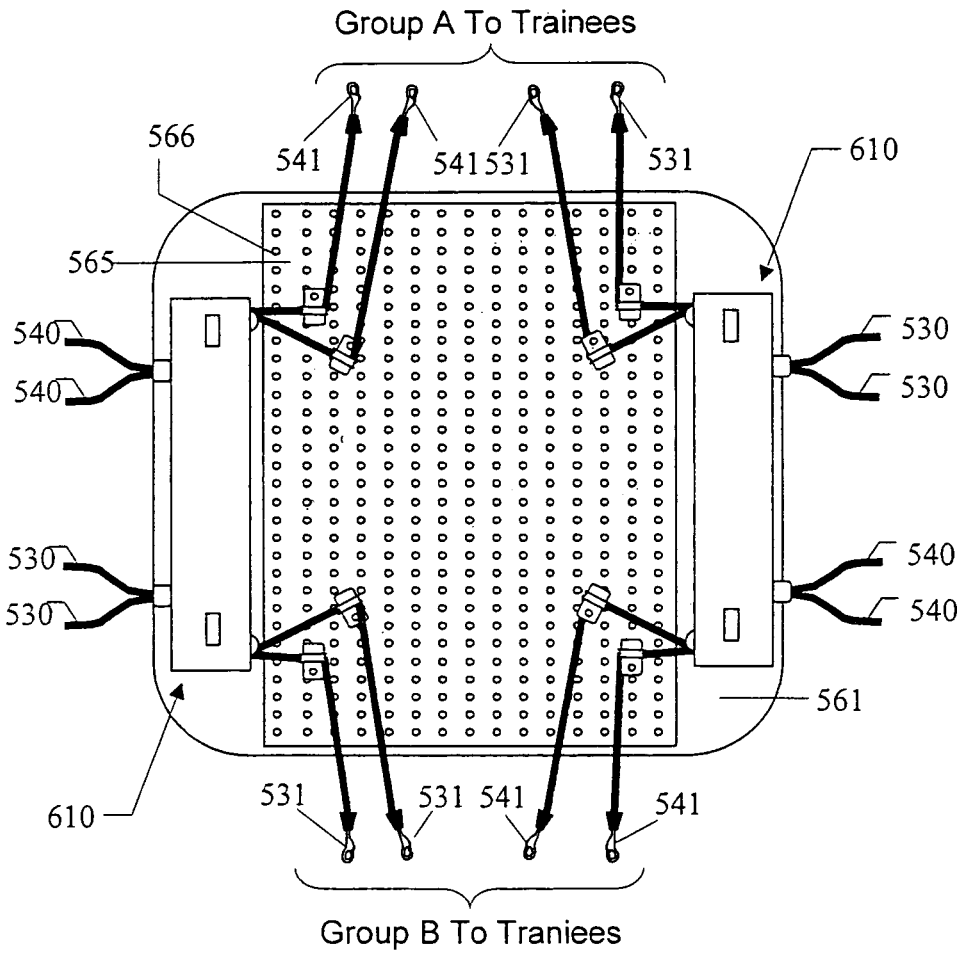
FIG. 56 is a top plan view of the lateral training apparatus of FIG. 55 with additional mechanical assemblies providing eight resistance members.
Figure 57:
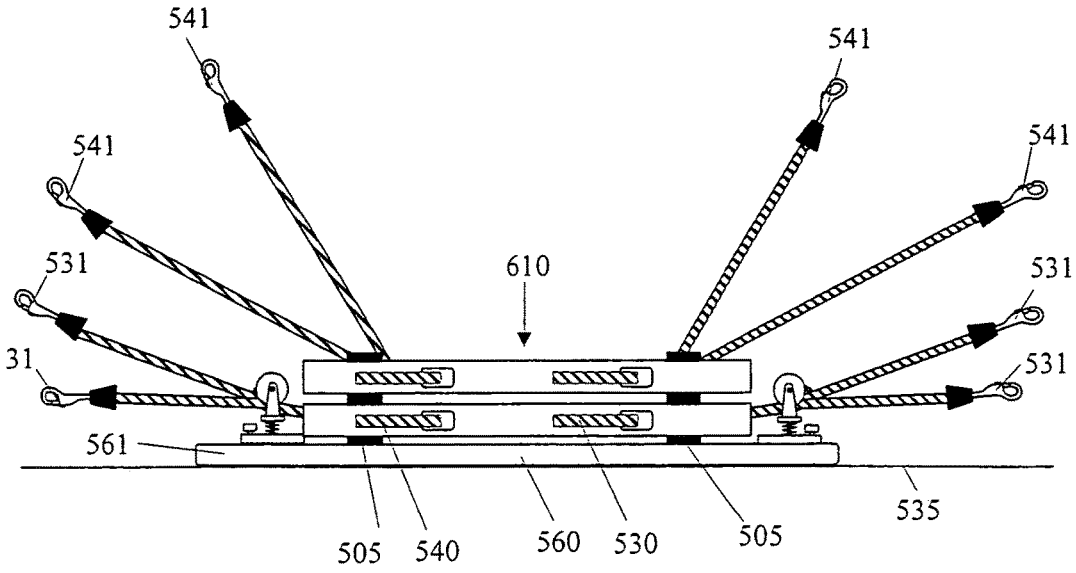
FIG. 57 is a side view of the lateral training apparatus of FIG. 56.

FIG. 56 is a top plan view of the lateral training apparatus of FIG. 55 with additional mechanical assemblies providing eight resistance members. FIG. 57 is a side view of the lateral training apparatus of FIG. 56. With reference to FIGS. 56 and 57, one or more assemblies or modules 510 may be interlocked and stacked to create the stacked configuration 610 and provide eight resistance members for exercise by one or more trainees. Of course, any number of elastic members may be routed to either side of the apparatus for use by multiple trainees simultaneously.

Figure 58:
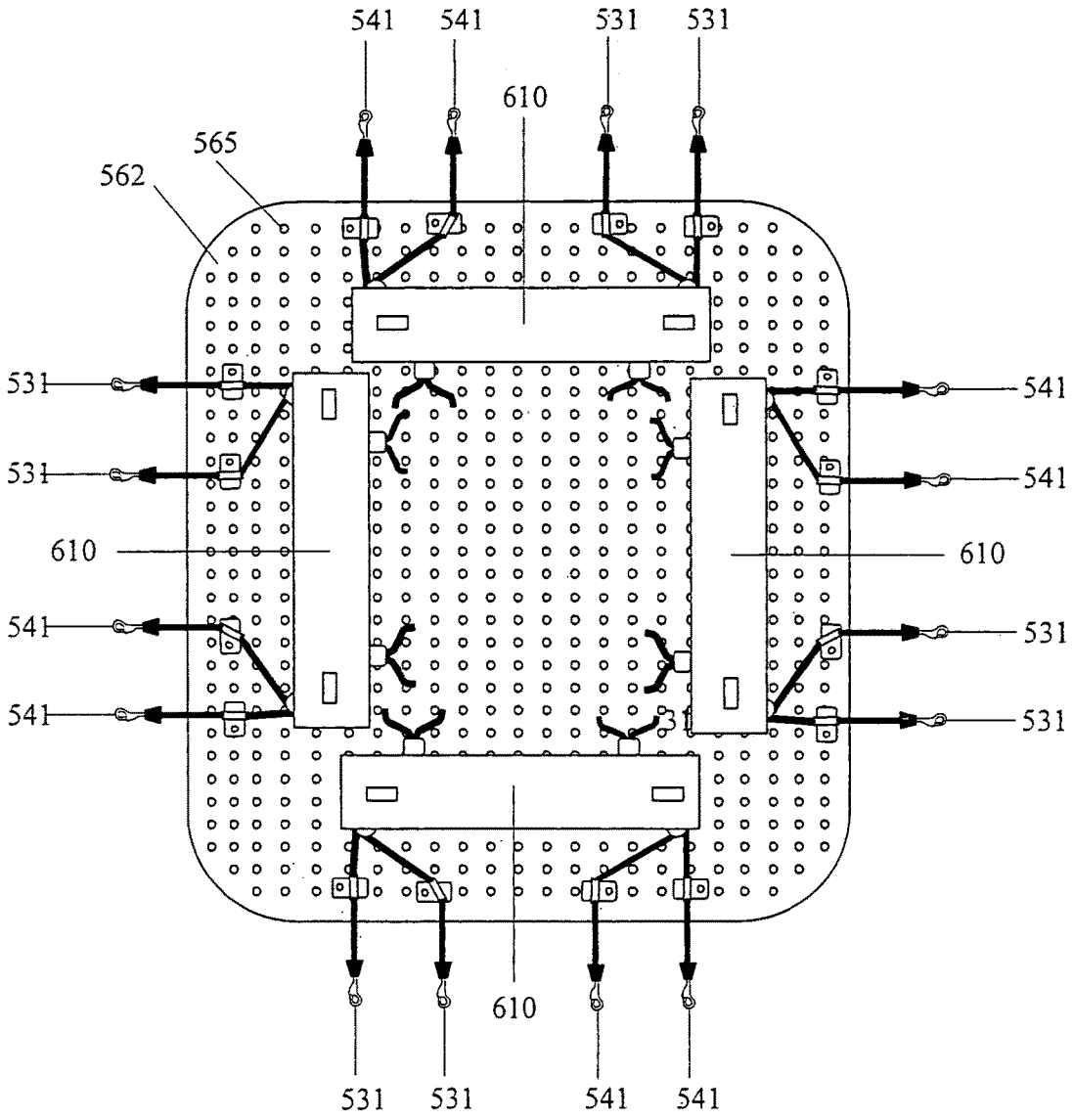
FIG. 58 is a top plan view of another lateral training apparatus according to an embodiment of the present subject matter.

FIG. 58 is a top plan view of another lateral training apparatus according to an embodiment of the present subject matter. With reference to FIG. 58, the lateral. training apparatus may include a base 562 having a flat structure 565 with multiple receptacles or perforations to receive the pulley assemblies and any number of single mechanical assemblies 510 or stacked assembly configurations 610. The flat structure 565 may be molded into or affixed to the base 562. The illustrated embodiment comprises four stacked assembly configurations 610 in such a pattern to allow four elastic training elements to be provided in all four directions off the base 562. This exemplary configuration may accommodate one to sixteen trainee depending upon the number of elastic members attached to each trainee.

Figure 59:
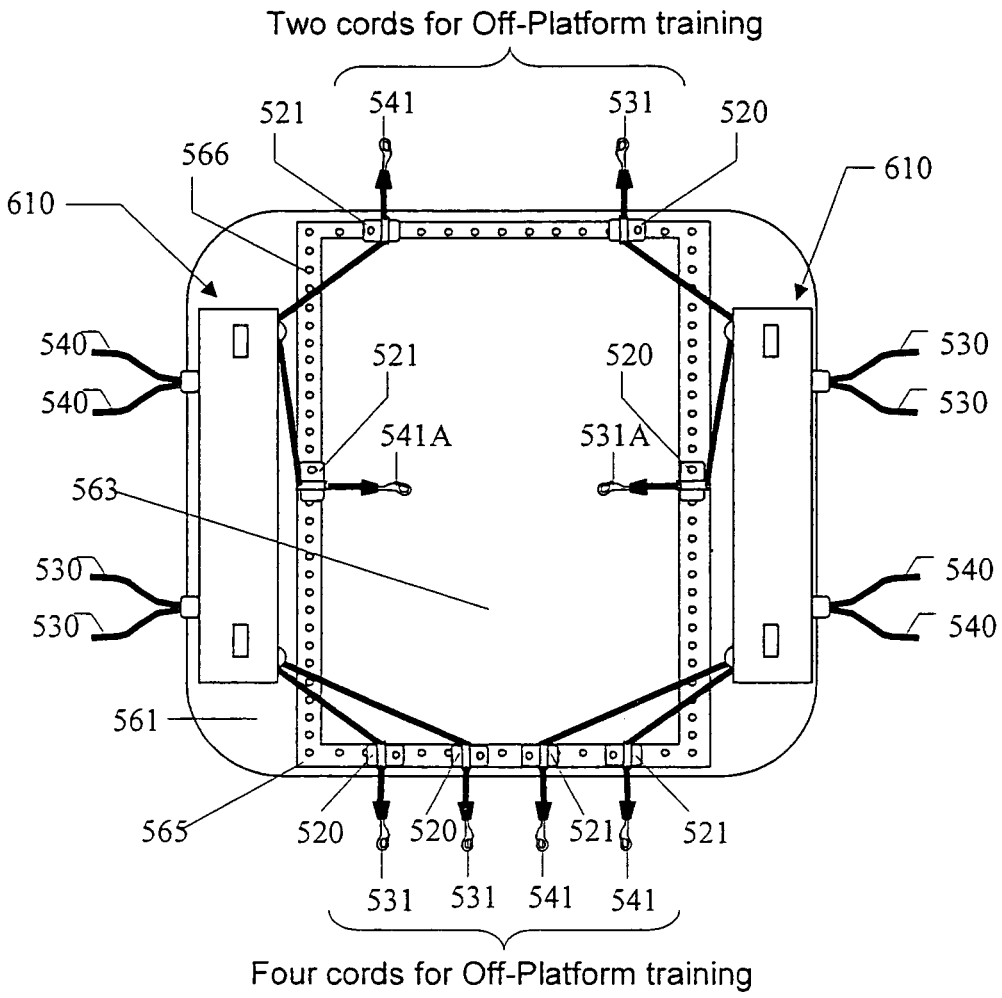
FIG. 59 is a top plan view of another embodiment of the present subject matter.
Figure 60:
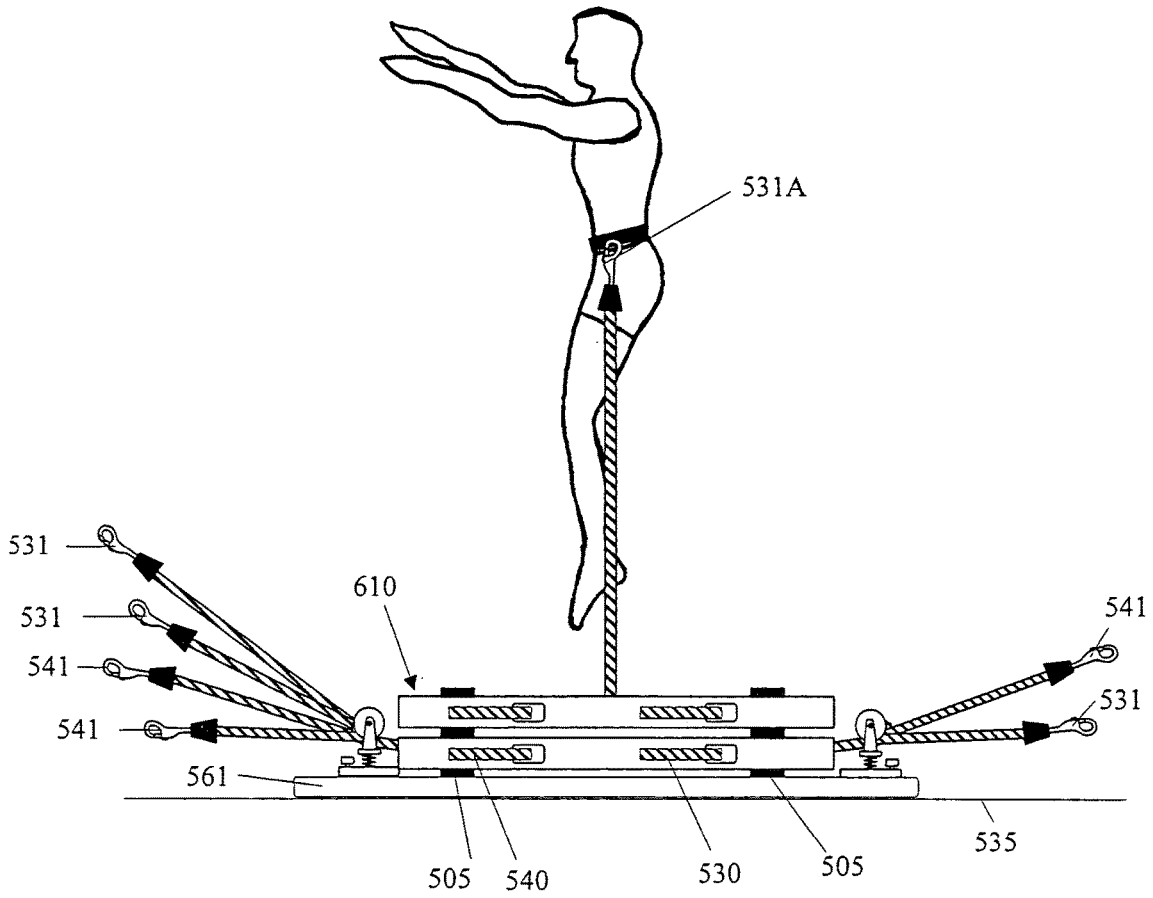
FIG. 60 is a side view of FIG. 59 with a trainee in an extended position of a vertical jump training exercise.

FIG. 59 is a top plan view of another embodiment of the present subject matter that replaces a majority of the area defined by the flat structure 565 in FIG. 58 with an exercise area or mat 563. FIG. 60 is a side view of FIG. 59 with a trainee in an extended position of a vertical jump training exercise. With reference to FIGS. 59 and 60, the outer perimeter of the area defined by the flat structure 565 may remain to provide an attachment area for pulley assemblies 520, 521 around the perimeter of the mat. By positioning the connector means 541A, 531A and respective elastic members, a trainee may now stand on the mat 563 and perform many ground based exercises as well as vertical jump training exercises. It should be noted that any of the elastic members may be held by the hands or attached to any part of the body via a garment, strap, etc. for the purpose of providing exercise resistance.

Figure 61:
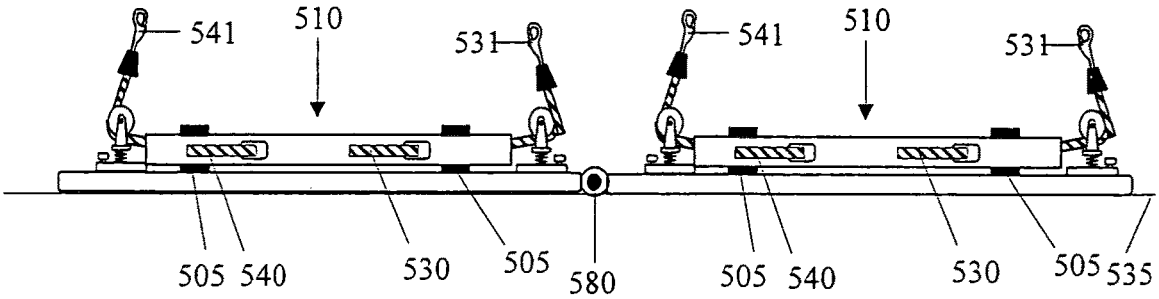
FIG. 61 is a side view of a hinged lateral training apparatus according to an embodiment of the present subject matter.
Figure 62:
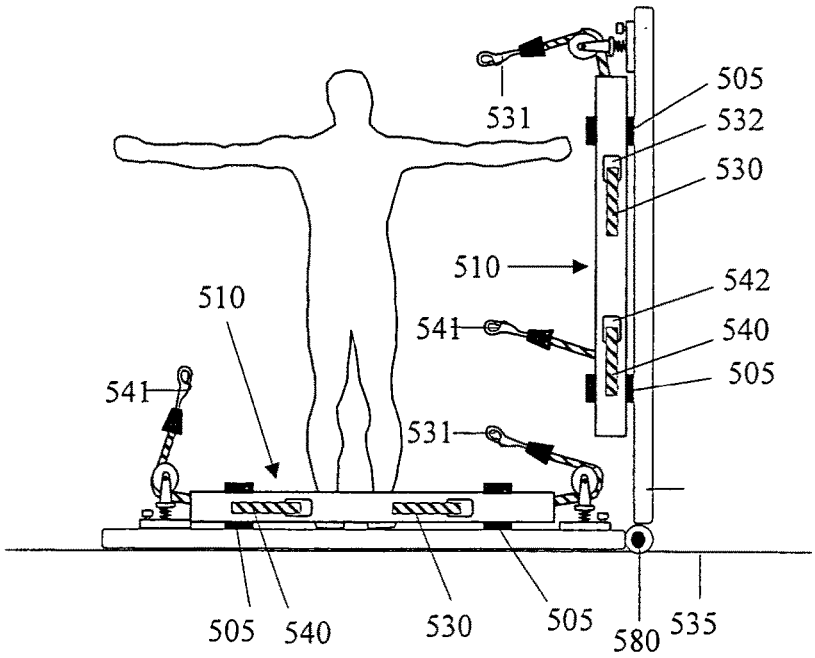
FIG. 62 is a side view of the hinged lateral training apparatus of FIG. 61 with the hinge locked in a ninety degree position.
Figure 63:
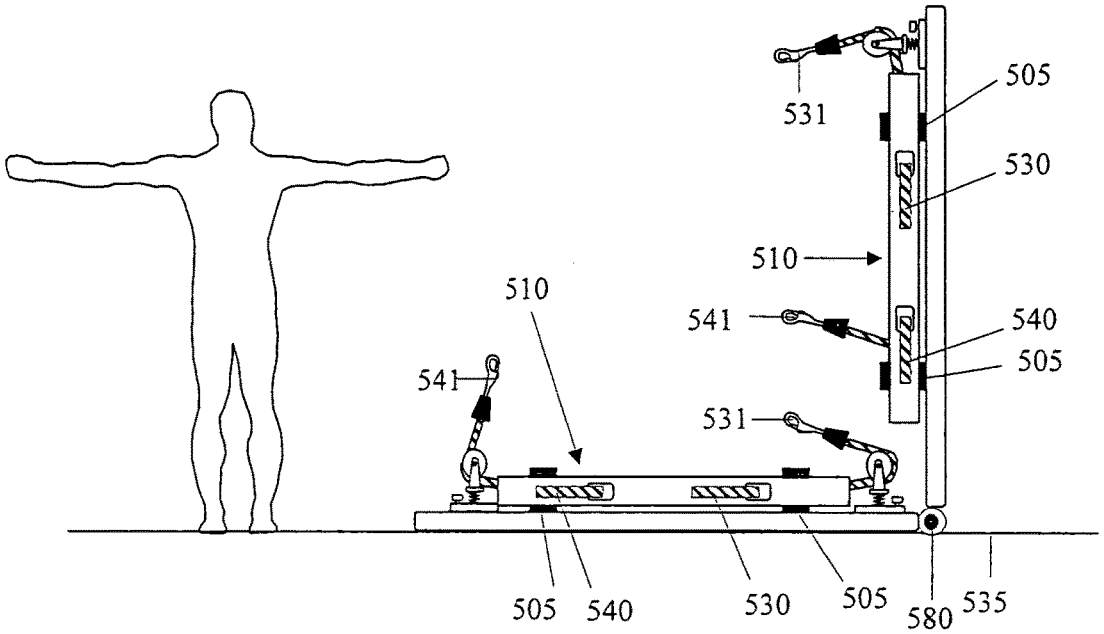
FIG. 63 is a side view of the hinged lateral training apparatus of FIG. 62 with the trainee in a different position off-platform.

FIG. 61 is a side view of a hinged lateral training apparatus according to an embodiment of the present subject matter. With reference to FIG. 61, two lateral training apparatuses depicted in FIG. 53 may be suitably connected utilizing a hinge 580 with locking abilities at a predetermined angle such as, but not limited to, ninety degrees. FIG. 62 is a side view of the hinged lateral training apparatus of FIG. 61 with the hinge locked in a ninety degree position. With reference to FIG. 62, the hinged configuration may provide an on-platform exercise capability to a trainee with true vertical loading from beneath the trainee and lateral loading emanating from many angles and elevations from one side. FIG. 63 is a side view of the hinged lateral training apparatus of FIG. 62 with the trainee in a different position off-platform. Any one or multiple elastic members may be utilized by the trainee to perform off-platform exercises.

It is an aspect of embodiments of the present subject matter to provide nearly constant resistance to a trainee at a significant distance from a lateral training apparatus (e.g., 30 feet or more). This is accomplished by directing one or more elastic members from the apparatus through a network of pulleys. The pulleys may be contained in a mechanical assembly and/or may be directly mounted, carried or attached to the base. The mechanical routing design of the mechanical assemblies may allow long lengths of elastic members (e.g., 100+ feet) to be contained therein. Therefore, when the trainee moves away from the apparatus 30 feet or more, applied resistance will not increase appreciably as the elastic members are stretched one third of its respective overall length. Additional mechanical assemblies that may be utilized in exemplary embodiments may employ electronic, pneumatic, hydraulic, spring, and/or motor mechanisms rather than elastic members to provide the resistance for a trainee.

It is also an aspect of embodiments of the present subject matter to provide resistance training for numerous sports specific movements, such as, but not limited to, kicking, boxing, sprinting, pitching, throwing, passing, vertical jump training, golfing, lateral sports movements, and the like. Further the plural configurations of embodiments of the present subject matter may uniquely apply multiple, e.g., eight or more, elastic members to uniquely apply training vectors to a trainee's waist, shoulders, arms, thighs, ankles, etc., simultaneously while performing highly complex athletic motions. Thus, it is also an aspect to provide an exercise apparatus capable of applying single or multiple lateral loads with selectable vertical and horizontal components that obviates the problems of the prior art and that can be used in a variety of locations.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A method for sprint exercising a trainee sprinting on the ground away from an apparatus, comprising the acts of:

(a) providing an apparatus comprising:

(i) a mount;

(ii) a left leg elastic cord having an elastic portion of at least 25 feet in length, and a series of pulleys mounted on said mount with said left leg elastic cord running through said series of pulleys, said left leg elastic cord have an end external to the mount and adapted to be connected to the trainees' left leg at or below a left knee; and, (iii) a right leg elastic cord having an elastic portion of at least 25 feet in length, and a second series of pulleys mounted on said mount with said right leg elastic cord running through said second series of pulleys, said right leg elastic cord have an end external to the mount and adapted to be connected to the trainees' right leg at or below a right knee;

(b) connecting said left leg elastic cord to the trainee's left leg;

(c) connecting said right leg elastic cord to the trainee's right leg;

(d) the trainee sprinting on the ground away from said mount, (i) wherein each of said left leg elastic cord and right leg elastic cord each separately provide not more than about 60 pounds of lateral resistance when stretched throughout the trainee's 10-yard sprint distance ranging from zero to ten yards from said mount, and each separately do not vary in their respective amount of resistance throughout said 10-yard sprint distance by more than plus or minus 10 percent; and (ii) whereby said left leg elastic cord imparts lateral resistance to the trainees left leg hip flexor muscles while said left leg is moving forward during its swing phase simultaneously with the trainees' right leg downward drive phase; and, (iii) whereby said right leg elastic cord imparts lateral resistance to the trainees right leg hip flexor muscles while said right leg is moving forward during its swing phase simultaneously with the trainees' left leg downward drive phase.

2. The method of claim 1 and further comprising (e) wherein the step of providing the apparatus includes providing as part of said apparatus a midsection elastic cord having elastic portions of at least 25 feet in length, and a first series of pulleys mounted on said mount with said midsection elastic cord running through said first series of pulleys, said midsection elastic cord have an end external to said mount and adapted to be connected to the trainee's midsection; and, (f) connecting said midsection elastic cord to the trainee's midsection; and, (g) said act of sprinting includes said midsection elastic cord imparting lateral resistance alternating between the trainee's left leg downward drive phase and the trainee's right leg downward drive phase.

3. The method of claim 2 wherein during said sprinting the magnitude of resistance provided by said elastic cords is substantially independent of a distance of said trainee from said apparatus and is substantially independent of acceleration or deceleration of said trainee.

4. The method of claim 3 wherein said apparatus comprises:

at least one of said elastic cords secured at one end to an anchor and attached at the other end to a connector for connecting to the trainee; and wherein an effective length of the elastic cord between said anchor and said connector to the trainee is adapted to be selected by extracting one end of the at least one said elastic cords from the anchor and securing the at least one of said elastic cords with said anchor, whereby the magnitude of resistance of the at least one of said elastic cords is variable by varying said effective length between said anchor and said connector;

whereby said act of (d) sprinting occurs with resistance from said elastic cord both:

(iv) when the trainee is within close proximity to said apparatus; and (v) when the trainee is a further distance from said apparatus, with a relatively similar resistance profile in the at least one of said elastic cords as when the trainee is in close proximity to said apparatus.

5. The method of claim 4 wherein said apparatus comprises:

a tracking mechanism carried by said apparatus for directing the at least one of said elastic cords from said connector to said anchor.

6. The method of claim 5 wherein said connecting act further comprises the acts of:

placing around the trainee one or more connection items selected from a group consisting of: harness, strap, shoe, garment and combinations thereof; and, attaching a connector mechanism, which itself is attached to one of said elastic cords, to said connection item.

7. The method of claim 6 wherein the at least one of said elastic cords is 100 feet or greater long and is adapted for trainee training 30 feet or more away from said apparatus without appreciably increasing said resistance of the at least one of said elastic cords.

8. The method of claim 7 wherein said: (b) connecting said left leg elastic cord to the trainee's left leg comprises connecting said left leg elastic cord to the trainee's left foot or ankle; (c) connecting said right leg elastic cord to the trainee's 10 right leg comprises connecting said right leg elastic cord to the trainee's right foot or ankle.

9. The method of claim 8 wherein said apparatus includes a pulley assembly which allows movement of an origin of a training vector applied to the trainee via the at least one of said elastic cords, wherein said pulley assembly includes a pivoting and rotating pulley mounted on a base that is slidably carried by a track.

10. The method of claim 9 wherein said series of pulleys mounted on said mount are arranged in at least two stacked pulley assemblies within a module, each of said at least two stacked pulley assemblies having a plurality of stacked pulleys with the at least one of said elastic cords thereon.

11. The method of claim 1 wherein during said sprinting the magnitude of resistance provided by said left and right elastic cords is substantially independent of a distance of said trainees from said apparatus and is substantially independent of the acceleration or deceleration of said trainee.

12. The method of claim 1 wherein said apparatus comprises:

at least one of said elastic cords secured at one end to an anchor and attached at the other end to a connector for connecting to the trainee; and, wherein an effective length of the elastic cord between said anchor and said connector to the trainee is adapted to be selected by extracting one end of said elastic cord from the anchor and securing said elastic cord with said anchor, whereby the magnitude of resistance of said elastic cord is variable by varying said effective length between said anchor and said connector;

whereby said act of (d) sprinting occurs with resistance from said elastic cord both:

(iv) when the trainee is within close proximity to said apparatus; and, (v) when the trainee is a further distance from said apparatus, with a relatively similar resistance profile in said elastic cord as when the trainee is in close proximity to said apparatus.

13. The method of claim 1 wherein said apparatus comprises:

a tracking mechanism carried by said apparatus for directing said left or right leg elastic member from said connector to said anchor.

14. The method of claim 1 wherein said connecting act further comprises the acts of:

placing around the trainee one or more connection item selected from the group consisting of: harness, strap, shoe and garment and combinations thereof; and, attaching a connector mechanism, which itself is attached to one of said left or right leg elastic cords, to said connection item.

15. The method of claim 1 wherein at least one of said left and right leg elastic cord is 100 feet or greater long and is adapted for trainee training 30 feet or more away from said apparatus without appreciably increasing said resistance of said left or right leg elastic member.

16. The method of claim 1 wherein said: (b) connecting said left leg elastic cord to the trainee's left leg comprises connecting said left leg elastic cord to the trainee's left foot or ankle; (c) connecting said right leg elastic cord to the trainee's right leg comprises connecting said right leg elastic cord to the trainee's right foot or ankle.

17. The method of claim 1 wherein said apparatus includes a pulley assembly which allows movement of an origin of a training vector applied to the trainee via at least one of said left and right leg elastic cords, wherein said pulley assembly includes a pivoting and rotating pulley mounted on a base that is slidably carried by a track.

18. The method of claim 1 wherein said series of pulleys mounted on said mount are arranged in at least two stacked assemblies within a module, each of said at least two stacked pulley assemblies having a plurality of stacked pulleys with the at least one of said elastic cords thereon.

19. A dynamic physical training system for providing a substantially constant load over an operational range while minimizing inertial loads, the system comprising:

a portable housing:

a plurality of phase loading subsystems attached to the housing, each subsystem comprising:

an elastic cord; the elastic cord having a high resistance/mass ratio;

a set of nested cord guides, each of the cord guides fixed translationally with respect each other;

an anchor fixed with respect to the housing and connected to an end of the elastic cord;

an exit guide;

an attachment device, said attachment device connected to another end of the elastic cord and an external object;

wherein said elastic cord is threaded from the anchor through the set of cord guides and exits the housing via the exit guide, said elastic cord having a predetermined constant length between the anchor and exit guide when the elastic cord is stretched and wherein the attachment device is external of the housing;

said elastic cord is in a first position with a first non zero tension, and the another end of the elastic cord having a second position having a second tension greater than the first non-zero tension;

said first and second tensions being substantially constant over the stretched length of the cord between the anchor and a respective position of the attachment device;

wherein said elastic cord has an operational range from the first position to the second position, the first tension is within 10% of the second tension, and wherein the operational range is at least 60% of the constant length;

wherein the tensions of each of the plurality of phase loading subsystems are independent and wherein the respective attachment devices of each subsystem is configured to connect to a different portion of the trainee.

20. The system of claim 19, wherein the constant length is 40 feet or greater.

21. The system of claim 20, wherein the constant length is 70 feet or greater.

22. The system of claim 21, wherein a distance between the second position and the exit guide is 135 feet or more.

23. The system of claim 20, wherein a distance between the second position and the exit guide is 75 feet or more.

24. A method for dynamic physical training of a trainee, the method comprising:

loading the trainee during a first phase by encircling a first portion of the trainee with one or more first attachment devices and connecting the one or more first attachment devices to one end of a first phase loading subsystem;

loading the trainee during a second phase by encircling a second portion of the trainee with one or more second attachment device to attach the attachment device to the trainee the one or more second attachment devices to one end of a second phase loading subsystem;

applying with the respective phase loading subsystems, a substantially constant, acceleration and velocity independent resistive force towards the respective phase loading subsystems over a predetermined operational range;

wherein the loading during the respective phases are simultaneous and independent; and the first, and second phases are coupled with respect to the dynamic physical training and have different dynamic characteristics;

providing a movable or slidable pulley assembly for each loading subsystem to permit movement of the origin of training vectors for the resistive force applied to the trainee by the respective subsystem;

wherein each of the first and second phase loading subsystem include an elastic cord threaded through three or more pulleys, wherein a location of each of the three or more pulleys are fixed with respect to each other.

25. The method of claim 24, further comprising loading the trainee during the second phase by attaching one or more third attachment devices to a third portion of the trainee, wherein the one or more third attachment devices are connected to another end of the second phase loading subsystem.

26. A method providing a substantially constant load over an operational range while minimizing inertial loads for dynamic physical training of a trainee, the method comprising:

loading the trainee during a drive phase by attaching one or more first attachment devices to the first portion of the trainee, wherein the one or more first attachment device is connected to one end of a first phase loading subsystem;

loading the trainee during a swing phase by attaching one or more second attachment device to a second portion of the trainee, wherein the one or more second attachment device is connected to one end of a second phase loading subsystem;

wherein the drive and swing, phase loading subsystems are attached to a mounting frame and each comprise:

an elastic cord having one end and another end; the elastic cord having a high resistance/mass ratio;

a set of nested cord guides, each of the cord guides fixed translationally with respect each other;

an anchor fixed with respect to the mounting frame and connected to the another end of the elastic cord;

an exit guide;

wherein said elastic cord is threaded from the anchor through the set of cord guides and exits via the exit guide;

wherein said elastic cord has a first position with a first non zero tension, said first position being beyond the exit guide and the elastic cord having a second position having a second tension, wherein a stretched length of the elastic cord between the anchor and the exit guide is a constant length and the stretched length of the elastic cord between the first position and the second position is at least 60% of the constant length;

said first and second tensions being substantially constant over the stretched length of the cord between the anchor and the respective position of the one end;

wherein the tensions of each of the plurality of phase loading subsystems are independent and wherein the respective attachment devices are configured to connected to a different portion of a trainee.

27. A module for use by a user in physical training, the module providing a substantially constant load over an operational range, the module comprising:

a housing having a plurality of walls defining an interior;

a first plurality of pulleys having at least two pulleys mounted in the interior of the housing between two of the plurality of walls;

a second plurality of pulleys mounted in the interior of the housing, the second plurality of pulleys being spaced apart from said first plurality of pulleys;

an anchor mounted to said housing;

an exit guide mounted to said housing;

an elastic cord having a first end portion mounted to said anchor, a second end portion extending externally from the exit guide and an intermediate portion extending from the anchor and passing through said first and second sets of pulleys to said exit guide;

an attachment device mounted to the second end portion of the elastic cord adapted to be connected to the user; and a peg or keyway formed on the housing for supporting the housing on a base or other housing.

28. The module of claim 27, wherein the anchor is a locking mechanism.

29. The module of claim 27, wherein the first plurality of pulleys is a stacked set of pulley.

* * * * *